US010005583B2

(12) United States Patent
Melrose

(10) Patent No.: US 10,005,583 B2
(45) Date of Patent: Jun. 26, 2018

(54) PRESSURE CONTAINER WITH DIFFERENTIAL VACUUM PANELS

(71) Applicant: David Murray Melrose, Auckland (NZ)

(72) Inventor: David Murray Melrose, Auckland (NZ)

( * ) Notice: Subject to any disclaimer, the term of this patent is extended or adjusted under 35 U.S.C. 154(b) by 795 days.

(21) Appl. No.: 14/106,703

(22) Filed: Dec. 13, 2013

(65) Prior Publication Data

US 2014/0346135 A1 Nov. 27, 2014

Related U.S. Application Data

(60) Continuation-in-part of application No. 12/595,830, filed as application No. PCT/NZ2008/000079 on Apr. 11, 2008, now abandoned, application No. 14/106,703, which is a continuation-in-part of application No. 13/270,886, filed on Oct. 11, 2011, which is a continuation of application No. (Continued)

(30) Foreign Application Priority Data

Sep. 30, 2004 (NZ) ..... 535772
Apr. 13, 2007 (NZ) ..... 554532

(51) Int. Cl.
*B65D 23/10* (2006.01)
*B65D 1/02* (2006.01)
*B65D 79/00* (2006.01)

(52) U.S. Cl.
CPC ..... *B65D 1/0223* (2013.01); *B65D 79/005* (2013.01); *B65D 2501/0036* (2013.01)

(58) Field of Classification Search
CPC ..... B65D 1/0223; B65D 79/005; B65D 2501/0036; B65D 2501/0081; B65D 2501/0027
USPC ..... 215/379, 381, 384, 382, 383; 220/669, 220/675, 695, 666; D9/538
See application file for complete search history.

(56) References Cited

U.S. PATENT DOCUMENTS

D191,069 S 8/1961 Schacher
3,325,031 A 6/1967 Singier
(Continued)

FOREIGN PATENT DOCUMENTS

AU 2005202086 11/2006
EP 1 431 190 A1 6/2004
(Continued)

OTHER PUBLICATIONS

"And Constar Makes Three in the Hot-Fill, Panel-Less Bottle Race," Aug. 31, 2005, p. 5 (www.packstrat.com).
(Continued)

*Primary Examiner* — Fenn C Mathew
*Assistant Examiner* — Cynthia Collado
(74) *Attorney, Agent, or Firm* — Henricks, Slavin & Holmes LLP

(57) ABSTRACT

A plastic container (1) has a first set of flex panels (2) and a second set of flex panels (3) one set being adapted to react to pressure changes within the container to a different degree than the other set. This can be achieved by different curvature and/or size and/or different distance from a central longitudinal axis of the container. At least one of the panels has at least two different extents of curvature. In some embodiments one or more of the panels may be flat.

40 Claims, 19 Drawing Sheets

Related U.S. Application Data

11/664,265, filed as application No. PCT/US2005/035241 on Sep. 30, 2005, now Pat. No. 8,186,528, application No. 14/106,703, which is a continuation-in-part of application No. 13/357,232, filed on Jan. 24, 2012, which is a division of application No. 11/664,265, filed as application No. PCT/US2005/035241 on Sep. 30, 2005, now Pat. No. 8,186,528.

(56) References Cited

U.S. PATENT DOCUMENTS

| | | | | |
|---|---|---|---|---|
| 3,536,500 | A | 10/1970 | Cleereman et al. | |
| D234,911 | S | 4/1975 | Stevens, Jr. | |
| 3,923,178 | A | 12/1975 | Welker, III | |
| D263,026 | S | 2/1982 | Beechuk et al. | |
| 4,372,455 | A | 2/1983 | Cochran | |
| 4,497,855 | A | 2/1985 | Agrawal et al. | |
| 4,805,788 | A * | 2/1989 | Akiho | B65D 1/0223 215/381 |
| 4,877,141 | A | 10/1989 | Hayashi et al. | |
| 4,946,053 | A | 8/1990 | Conrad | |
| 5,092,474 | A | 3/1992 | Leigner | |
| 5,101,990 | A | 4/1992 | Krishnakumar et al. | |
| 5,178,290 | A | 1/1993 | Ota et al. | |
| D335,455 | S | 5/1993 | Brown | |
| 5,226,538 | A | 7/1993 | Roselle | |
| 5,238,129 | A | 8/1993 | Ota | |
| 5,303,834 | A * | 4/1994 | Krishnakumar | B65D 1/0223 215/381 |
| 5,330,054 | A | 7/1994 | Brown | |
| 5,337,909 | A | 8/1994 | Vailliencourt | |
| 5,341,946 | A * | 8/1994 | Vailliencourt | B65D 1/0223 215/381 |
| 5,472,105 | A | 12/1995 | Krishnakumar et al. | |
| 5,690,244 | A | 11/1997 | Darr | |
| D399,391 | S | 10/1998 | Malvasi et al. | |
| 5,971,184 | A * | 10/1999 | Krishnakumar | B65D 23/102 215/379 |
| 6,044,996 | A | 4/2000 | Carew et al. | |
| D435,453 | S | 12/2000 | Krishnakumar et al. | |
| D436,042 | S | 1/2001 | Krishnakumar et al. | |
| D436,043 | S | 1/2001 | Krishnakumar et al. | |
| D442,492 | S | 5/2001 | Krishnakumar et al. | |
| D446,730 | S | 8/2001 | Adee et al. | |
| D462,273 | S | 9/2002 | Crawford | |
| D466,414 | S | 12/2002 | Venkataraman et al. | |
| 6,494,333 | B2 | 12/2002 | Sasaki et al. | |
| 6,513,669 | B2 | 2/2003 | Ozawa et al. | |
| 6,637,613 | B2 | 10/2003 | Shimada et al. | |
| D482,976 | S | 12/2003 | Melrose | |
| 6,739,467 | B2 | 5/2004 | Saito et al. | |
| 6,837,390 | B2 * | 1/2005 | Lane | B65D 1/0223 215/381 |
| 6,920,992 | B2 * | 7/2005 | Lane | B65D 1/0223 215/381 |
| 6,935,525 | B2 | 8/2005 | Trude | |
| 7,014,056 | B2 | 3/2006 | Trude | |
| D522,870 | S | 6/2006 | Venkataraman et al. | |
| D525,529 | S | 7/2006 | Oguchi et al. | |
| 7,073,675 | B2 | 7/2006 | Trude | |
| 7,118,002 | B2 | 10/2006 | Saito et al. | |
| 7,137,520 | B1 | 11/2006 | Melrose | |
| D533,785 | S | 12/2006 | Corbett et al. | |
| D535,884 | S | 1/2007 | Davis et al. | |
| D536,255 | S | 2/2007 | Corbett et al. | |
| D538,168 | S | 3/2007 | Davis et al. | |
| 7,191,910 | B2 * | 3/2007 | Deemer | B65D 1/0223 215/381 |
| 7,198,164 | B2 | 4/2007 | Yourist et al. | |
| D542,666 | S | 5/2007 | Trude | |
| 7,213,719 | B2 | 5/2007 | Pedmo et al. | |
| D547,664 | S | 7/2007 | Davis et al. | |
| 7,296,702 | B2 | 11/2007 | Tanaka et al. | |
| 7,377,399 | B2 | 5/2008 | Lane et al. | |
| 7,416,090 | B2 | 8/2008 | Mooney et al. | |
| 7,455,189 | B2 | 11/2008 | Lane et al. | |
| 7,458,478 | B2 | 12/2008 | Kamineni | |
| 7,472,798 | B2 | 1/2009 | Stowitts | |
| 7,810,664 | B2 | 10/2010 | Trude | |
| 8,087,525 | B2 | 1/2012 | Kelley et al. | |
| 8,109,398 | B2 | 2/2012 | Lewis et al. | |
| 8,186,528 | B2 | 5/2012 | Melrose et al. | |
| 9,162,807 | B2 | 10/2015 | Melrose et al. | |
| 2001/0022291 | A1 | 9/2001 | Shimada et al. | |
| 2001/0035392 | A1 * | 11/2001 | Ota | B65D 1/0223 215/381 |
| 2001/0054597 | A1 | 12/2001 | Ozawa et al. | |
| 2002/0000421 | A1 | 1/2002 | Ota et al. | |
| 2002/0008077 | A1 | 1/2002 | Lane et al. | |
| 2002/0092821 | A1 | 7/2002 | Saito et al. | |
| 2003/0136754 | A1 | 7/2003 | Bourque et al. | |
| 2003/0205550 | A1 | 11/2003 | Prevot et al. | |
| 2004/0016716 | A1 * | 1/2004 | Melrose | B65D 1/0223 215/381 |
| 2004/0200799 | A1 | 10/2004 | Yourist et al. | |
| 2005/0067369 | A1 | 3/2005 | Trude | |
| 2005/0121408 | A1 | 6/2005 | Deemer et al. | |
| 2005/0139572 | A1 | 6/2005 | Pedmo et al. | |
| 2005/0218107 | A1 | 10/2005 | Sabold et al. | |
| 2005/0218108 | A1 | 10/2005 | Bangi et al. | |
| 2006/0065618 | A1 * | 3/2006 | Pedmo | B65D 1/0223 215/381 |
| 2006/0070977 | A1 | 4/2006 | Howell et al. | |
| 2006/0076310 | A1 | 4/2006 | Mooney et al. | |
| 2006/0157439 | A1 | 7/2006 | Howell | |
| 2006/0180568 | A1 | 8/2006 | Lane | |
| 2007/0075032 | A1 * | 4/2007 | Kelley | B65D 1/0223 215/384 |
| 2007/0090083 | A1 | 4/2007 | Trude | |
| 2007/0125743 | A1 | 6/2007 | Pritchett et al. | |
| 2007/0187355 | A1 | 8/2007 | Kamineni | |
| 2007/0210028 | A1 | 9/2007 | Heisner et al. | |
| 2007/0257004 | A1 | 11/2007 | Howell et al. | |
| 2008/0257856 | A1 | 10/2008 | Melrose et al. | |
| 2009/0261059 | A1 * | 10/2009 | Pritchett, Jr. | B65D 1/0223 215/381 |
| 2010/0116778 | A1 | 5/2010 | Melrose | |
| 2010/0301003 | A1 | 12/2010 | Lewis et al. | |
| 2012/0160857 | A1 | 6/2012 | Melrose et al. | |
| 2012/0273453 | A1 | 11/2012 | Melrose | |

FOREIGN PATENT DOCUMENTS

| | | | |
|---|---|---|---|
| JP | 64-4662 | Y2 | 2/1989 |
| JP | 4-10012 | U | 1/1992 |
| JP | 3056271 | B | 2/1999 |
| JP | 2001-048147 | A | 2/2001 |
| JP | 2001-106217 | A | 4/2001 |
| JP | 2002-160717 | A | 6/2002 |
| NZ | 239179 | | 2/1993 |
| NZ | 513783 | | 12/2003 |
| NZ | 516023 | | 4/2004 |
| NZ | 554532 | | 4/2007 |
| NZ | 535722 | | 8/2007 |
| WO | WO-97-34808 | | 9/1997 |
| WO | WO-00/50309 | A | 8/2000 |
| WO | WO-2000/68095 | | 11/2000 |
| WO | WO-2005/067419 | A2 | 7/2005 |
| WO | WO-2006/039523 | A1 | 4/2006 |
| WO | WO2007/041422 | A1 | 4/2007 |
| WO | WO2008/127230 | A1 | 10/2008 |

OTHER PUBLICATIONS

Bevilacqua, V., International Search Report dated Feb. 8, 2006, issued for PCT/US2005/035241, ISA/EP, 3 pp.

Japanese Office Action dated Jul. 23, 2013, issued in related Japanese Patent Application No. 2012-114249, English-language translation only, 5 pp.

USPTO, File History for U.S. Appl. No. 11/529,486, filed Sep. 29, 2006, published as US2007/0075032.

(56) References Cited

OTHER PUBLICATIONS

USPTO, File History for U.S. Appl. No. 11/664,265, filed Jun. 16, 2008, published as US2008/0257856.
Bevilacqua, Vincent, International Search Report dated Feb. 27, 2007 for WO/2007/041422, WIPO, ISA/EP, 2 pp.
Xie, Shuiwei, International Search Report dated Aug. 13, 2008 for WO2008/127130, WIPO, IDA/AU, 2 pp.
USPTO, File History for U.S. Appl. No. 11/529,487, filed Sep. 29, 2006, published as US2007/0090083.
USPTO, File History for U.S. Appl. No. 12/476,350, filed Jun. 2, 2009, published as US2010/0301003.
USPTO, File History for U.S. Appl. No. 13/357,232, filed Jan. 24, 2012, published as US2012/0160857.
USPTO, File History for U.S. Appl. No. 12/595,830, filed Oct. 13, 2009, published as US2010/0116778.
USPTO, File History for U.S. Appl. No. 13/270,886, filed Oct. 11, 2011, published as US2012/0273453.

* cited by examiner

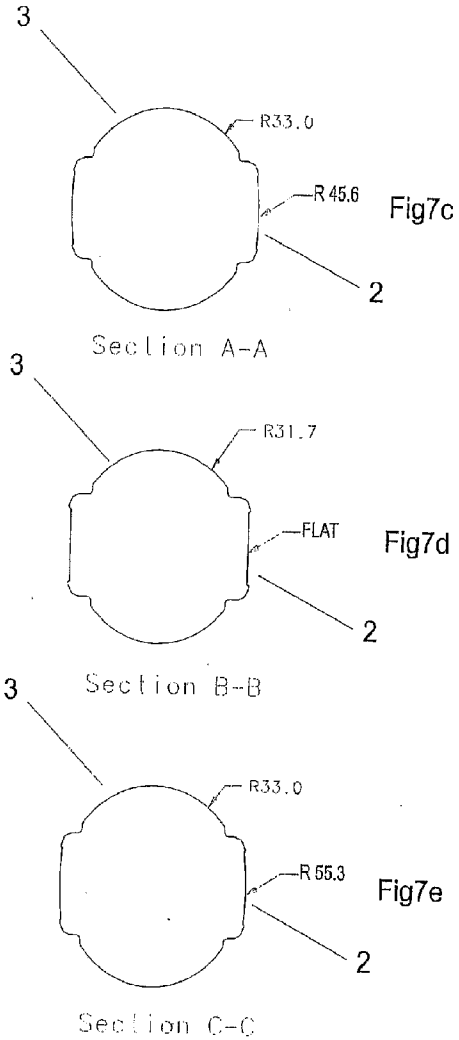
Fig7c
Fig7d
Fig7e
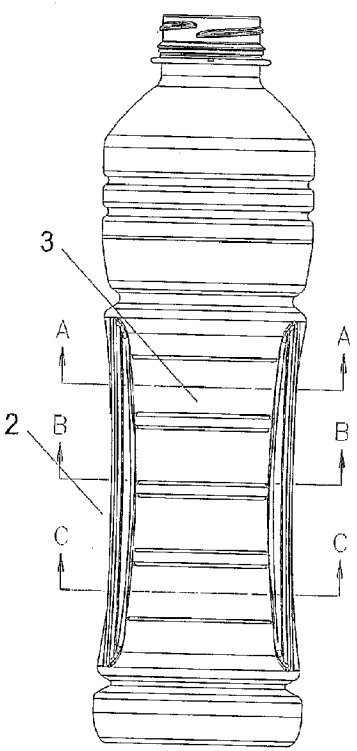
Fig7b
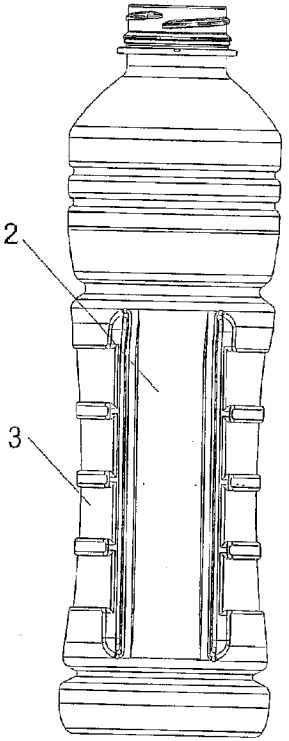
Fig7a

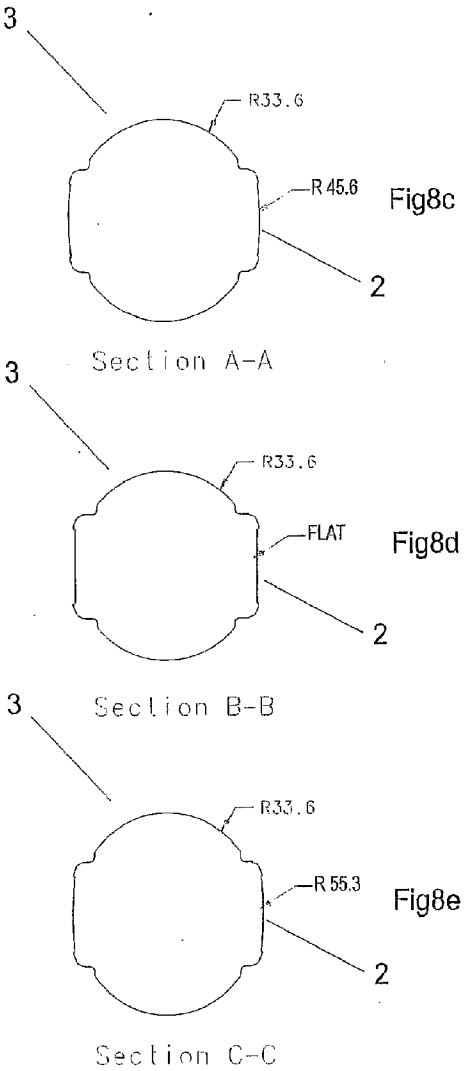
Fig8c
Fig8d
Fig8e
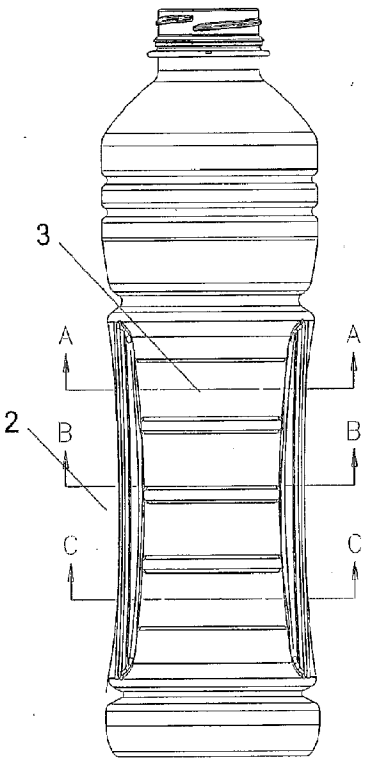
Fig8b
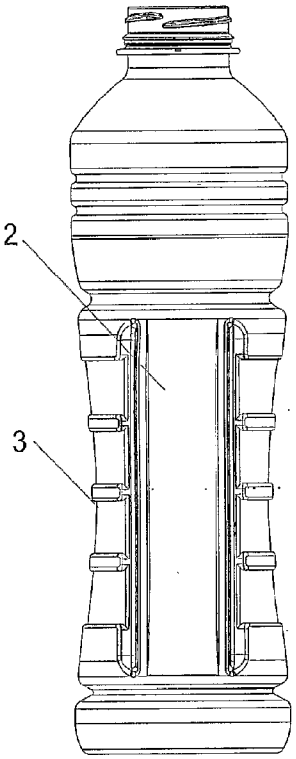
Fig8a

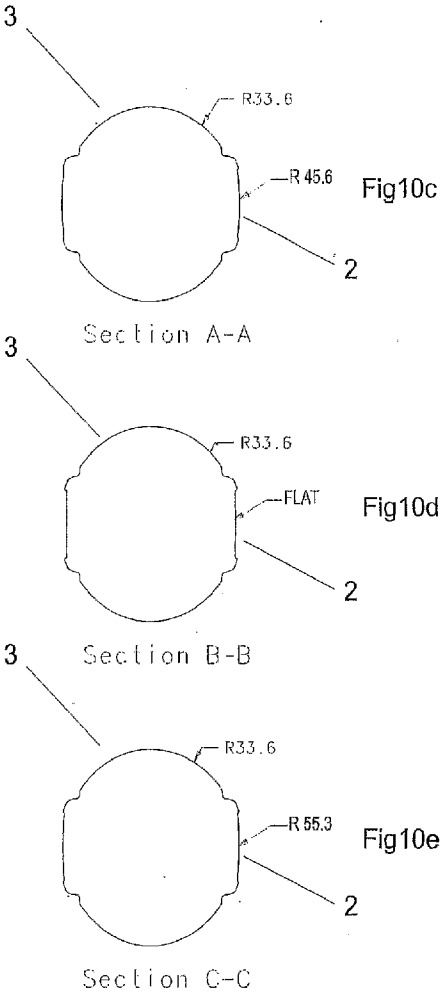
Fig10c
Fig10d
Fig10e
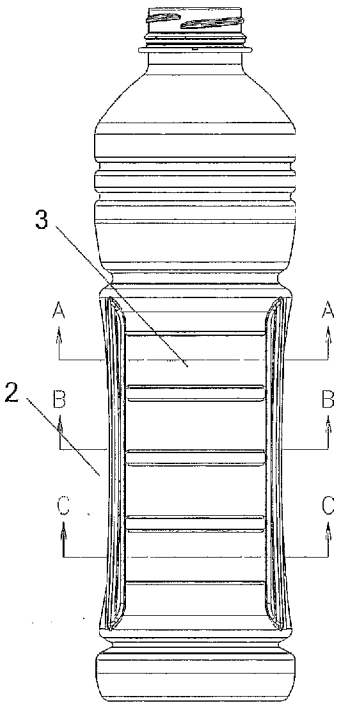
Fig10b
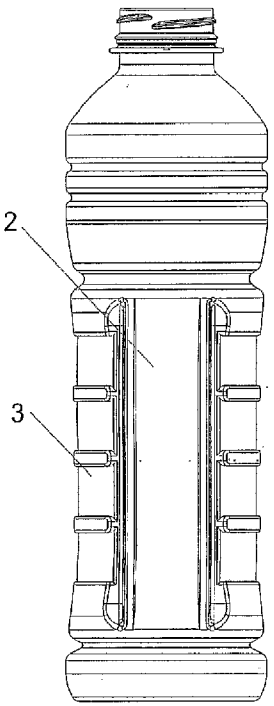
Fig10a

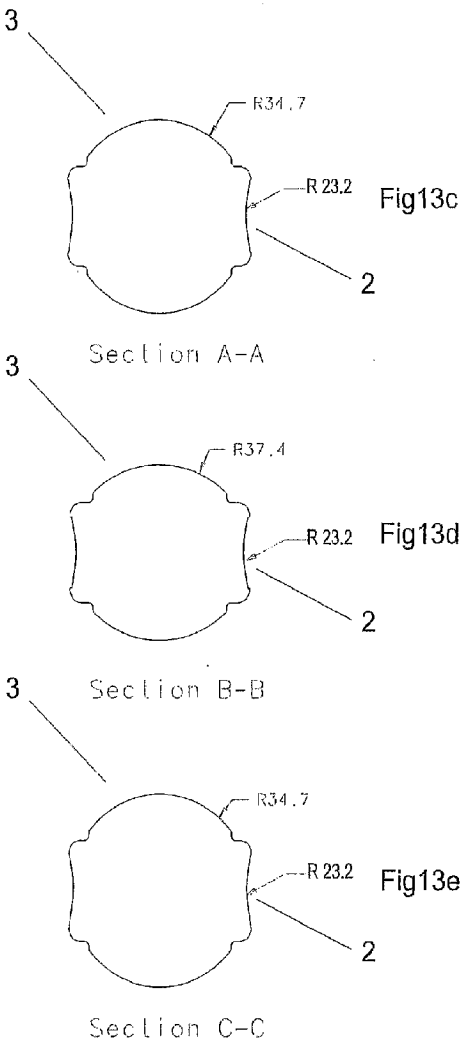
Fig13c
Fig13d
Fig13e
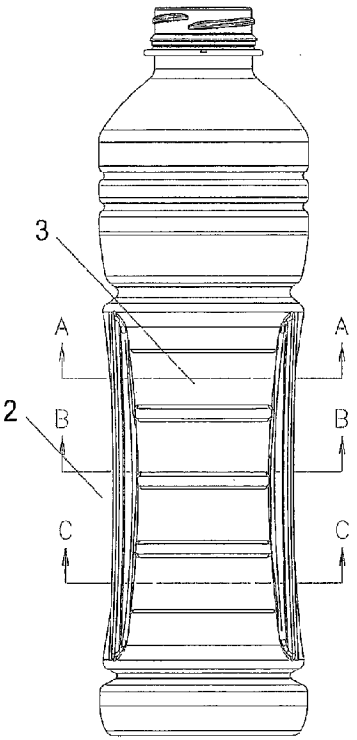
Fig13b
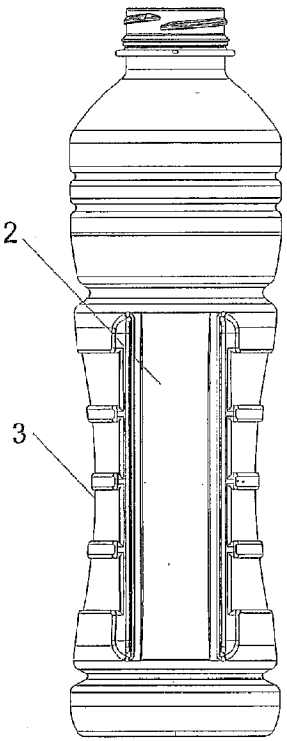
Fig13a

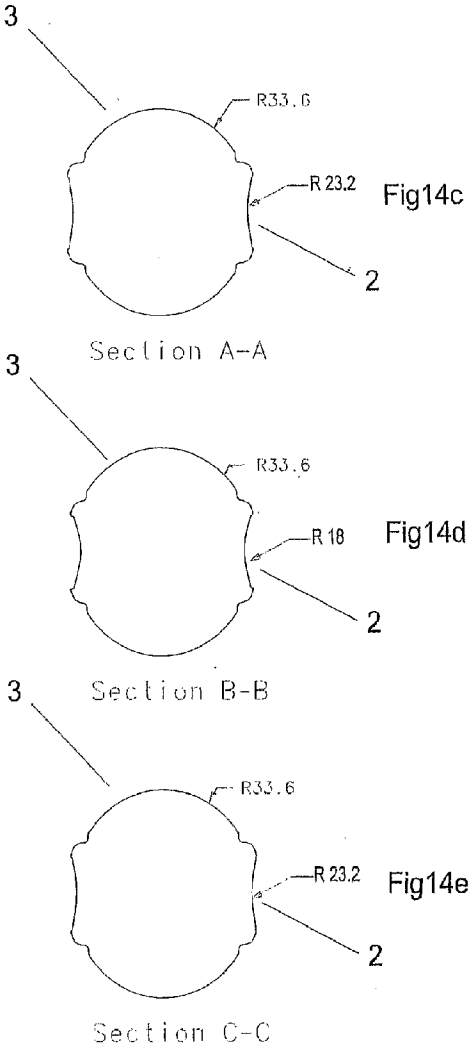
Fig14c
Fig14d
Fig14e
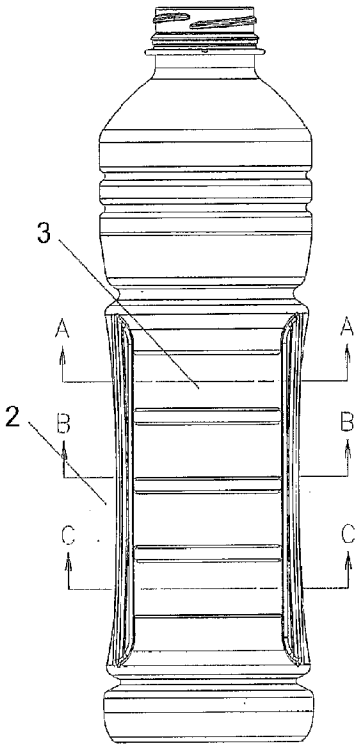
Fig14b
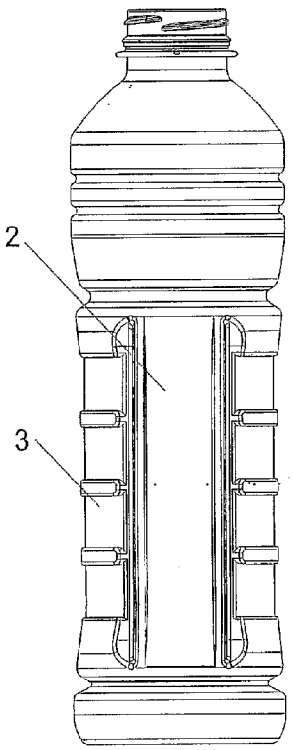
Fig14a

PRESSURE CONTAINER WITH DIFFERENTIAL VACUUM PANELS

CROSS REFERENCE TO RELATED APPLICATIONS

The present application is a continuation-in-part of U.S. patent application Ser. No. 12/595,830, filed Oct. 13, 2009 (the '830 application), currently pending and published as US2010/0116778, which is the U.S. National Phase of International Application No. PCT/NZ2008/000079, filed Apr. 11, 2008, and published as WO08/127,130 on Oct. 23, 2008, which claims priority to New Zealand Application No. 554532, filed Apr. 13, 2007.

The present application is a continuation-in-part of U.S. patent application Ser. No. 13/270,886, filed Oct. 11, 2011 (the '886 application), currently pending, which is a continuation of U.S. patent application Ser. No. 11/664,265, filed Jun. 16, 2008, now U.S. Pat. No. 8,186,528, issued May 29, 2012, which is the U.S. National Phase of International Application No. PCT/US2005/035241, filed Sep. 30, 2005, and published as WO06/039523 on Apr. 13, 2006, which claims priority to New Zealand Application No. 535772, filed Sep. 30, 2004.

The present application is a continuation-in-part of U.S. patent application Ser. No. 13/357,232, filed Jan. 24, 2012, currently pending, which is a divisional of U.S. patent application Ser. No. 11/664,265, filed Jun. 16, 2008, now U.S. Pat. No. 8,186,528, issued May 29, 2012, which is the U.S. National Phase of International Application No. PCT/US2005/035241, filed Sep. 30, 2005, which claims priority to New Zealand Application No. 535772, filed Sep. 30, 2004.

The disclosures, publications and patents of each of the aforementioned applications are incorporated herein by reference thereto.

FIELD OF THE INVENTIONS

The present invention relates to hot-fillable containers. More particularly, the present invention relates to hot-fillable containers having collapse panels.

BACKGROUND OF THE INVENTIONS

'Hot-Fill' applications impose significant and complex mechanical stress on a container structure due to thermal stress, hydraulic pressure upon filling and immediately after capping, and vacuum pressure as the fluid cools.

Thermal stress is applied to the walls of the container upon introduction of hot fluid. The hot fluid will cause the container walls to soften and then shrink unevenly, causing distortion of the container. The polyester must therefore be heat-treated to induce molecular changes resulting in a container that exhibits thermal stability.

Pressure and stress act upon the side walls of a heat resistant container during the filling process, and for a significant period of time thereafter. When the container is filled with hot liquid and sealed, there is an initial hydraulic pressure and an increased internal pressure is placed upon containers. As the liquid, and the air headspace under the cap, subsequently cool, thermal contraction results in partial evacuation of the container. The vacuum created by this cooling tends to mechanically deform the container walls.

Generally speaking, containers incorporating a plurality of longitudinal flat surfaces accommodate vacuum force more readily. Agrawal et al, U.S. Pat. No. 4,497,855 discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure, which would otherwise deform the inflexible post or land area structures. The amount of 'flex' available in each panel is limited, however, and as the limit is approached there is an increased amount of force that is transferred to the side walls.

To minimise the effect of force being transferred to the side walls, much prior art has focused on providing stiffened regions to the container, including the panels, to prevent the structure yielding to the vacuum force.

The provision of horizontal or vertical annular sections, or 'ribs', throughout a container has become common practice in container construction, and is not only restricted to hot-fill containers. Such annular sections will strengthen the part they are deployed upon. Cochran U.S. Pat. No. 4,372,455 discloses annular rib strengthening in a longitudinal direction, placed in the areas between the flat surfaces that are subjected to inwardly deforming hydrostatic forces under vacuum force. Akiho Ota et al U.S. Pat. No. 4,805,788 discloses longitudinally extending ribs alongside the panels to add stiffening to the container. Akiho Ota also discloses the strengthening effect of providing a larger step in the sides of the land areas. This provides greater dimension and strength to the rib areas between the panels. Akiho Ota et al, U.S. Pat. No. 5,178,290 discloses indentations to strengthen the panel areas themselves.

Akiho Ota et al, U.S. Pat. No. 5,238,129 discloses further annular rib strengthening, this time horizontally directed in strips above and below, and outside, the hot-fill panel section of the bottle.

In addition to the need for strengthening a container against both thermal and vacuum stress, there is a need to allow for an initial hydraulic pressure and increased internal pressure that is placed upon a container when hot liquid is introduced followed by capping. This causes stress to be placed on the container side wall. There is a forced outward movement of the heat panels, which can result in a barrelling of the container.

Thus, Hayashi et al, U.S. Pat. No. 4,877,141, discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

As stated, the use of blow molded plastic containers for packaging "hot-fill" beverages is well known. However, a container that is used for hot-fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot-fill liquid is introduced into the container. As the liquid cools, the liquid shrinks in volume which, in turn, produces a negative pressure or vacuum in the container. The container must be able to withstand such changes in pressure without failure.

Hot-fill containers typically comprise substantially rectangular vacuum panels that are designed to collapse inwardly after the container has been filled with hot liquid. However, the inward flexing of the panels caused by the hot-fill vacuum creates high stress points at the top and bottom edges of the vacuum panels, especially at the upper and lower corners of the panels. These stress points weaken the portions of the sidewall near the edges of the panels, allowing the sidewall to collapse inwardly during handling of the container or when containers are stacked together. See U.S. Pat. No. 5,337,909.

The presence of annular reinforcement ribs that extend continuously around the circumference of the container sidewall are shown in U.S. Pat. No. 5,337,909. These ribs are indicated as supporting the vacuum panels at their upper and lower edges. This holds the edges fixed, while permitting the center portions of the vacuum panels to flex inwardly while the bottle is being filled. These ribs also resist the deformation of the vacuum panels. The reinforcement ribs can merge with the edges of the vacuum panels at the edge of the label upper and lower mounting panels.

Another hot-fill container having reinforcement ribs is disclosed in WO 97/34808. The container comprises a label mounting area having an upper and lower series of peripherally spaced, short, horizontal ribs separated endwise by label mount areas. It is stated that each upper and lower rib is located within the label mount section and is centered above or below, respectively, one of the lands. The container further comprises several rectangular vacuum panels that also experience high stress point at the corners of the collapse panels. These ribs stiffen the container adjacent lower corners of the collapse panels.

Stretch blow molded containers such as hot-filled PET juice or sport drink containers, must be able to maintain their function, shape and labelability on cool down to room temperature or refrigeration. In the case of non-round containers, this is more challenging due to the fact that the level of orientation and, therefore, crystallinity is inherently lower in the front and back than on the narrower sides. Since the front and back are normally where vacuum panels are located, these areas must be made thicker to compensate for their relatively lower strength.

In discussing the above prior art the applicant does not acknowledge that it forms part of common general knowledge in New Zealand or in any other country or region.

SUMMARY OF THE INVENTIONS

The present invention provides according to one aspect a plastic container, having a body portion including a sidewall, wherein said body portion includes; a first controlled deflection flex panel on one sidewall portion and a second controlled deflection flex panel on a second sidewall portion, at least one of said controlled deflection flex panels having at least two different extents of outward curvature, said first and second flex panels being adapted to react to pressure changes within the container to a different degree. By way of example, a container having four controlled deflection flex panels may be disposed in two pairs on symmetrically opposing sidewalls, whereby one pair of controlled deflection flex panels responds to vacuum force at a different rate to an alternately positioned pair. The pairs of controlled deflection flex panels may be positioned an equidistance from the central longitudinal axis of the container, or may be positioned at differing distances from the centerline of the container. In addition the design allows for a more controlled overall response to vacuum pressure and improved dent resistance and resistance to torsion displacement of post or land areas between the panels. Further, improved reduction in container weight is achieved, along with potential for development of squeezable container designs.

According to another aspect of the invention a container for accommodating volume contraction within the container after being filled with a heated liquid has a side wall portion having four flex panels spaced apart around the circumference of a body portion and arranged as a first pair of opposed panels and a second pair of opposed panels, at least one of said flex panels having at least two different extents of curvature wherein the panels can deform inwardly to accommodate vacuum pressure caused by volume contraction of the heated liquid and wherein the panels are formed so the first pair of panels deforms inwardly at a different rate than the second pair of panels. Preferably each flex panel may have a generally variable outward curvature with respect to the centerline of the container. The first pair of panels may be positioned whereby one panel in the first pair is disposed opposite the other, and the first pair of panels has a geometry and surface area that is distinct from the alternately positioned second pair of panels. The second pair of panels may be similarly positioned whereby the panels in the second pair are disposed in opposition to each other. The containers are suitable for a variety of uses including hot-fill applications.

In hot-fill applications, the plastic container is filled with a liquid that is above room temperature and then sealed so that the cooling of the liquid creates a reduced volume in the container. In this preferred embodiment, the first pair of opposing controlled deflection flex panels, having the least total surface area between them, have a generally rectangular shape, wider at the base than at the top. These panels may be symmetrical to each other in size and shape. These controlled deflection flex panels have a substantially outwardly curved, transverse profile and an initiator portion toward the central region that is less outwardly curved than in the upper and lower regions. Alternatively, the amount of outward curvature could vary evenly from top to bottom, bottom to top, or any other suitable arrangement. Alternatively, the entire panel may have a relatively even outward curvature but vary in extent of transverse circumferential amount, such that one portion of the panel begins deflection inwardly before another portion of the panel. Alternatively, one pair of panels may be substantially flat or concave while the opposing pair of panels comprise controlled deflection flex panels having a variable outward curvature. Alternatively again, one pair of panels may be substantially evenly outwardly curved, while the opposing pair of panels comprise controlled deflection flex panels having a variable outward curvature. This first pair of controlled deflection flex panels may in addition contain one or more ribs located above or below the panels. These optional ribs may also be symmetric to ribs, in size, shape and number to ribs on the opposing sidewalls containing the second set of controlled deflection flex panels. The ribs on the second set of controlled deflection flex panels may have a rounded edge which may point inward or outward relative to the interior of the container. In a first preferred form of the invention, whereby the first pair of controlled deflection flex panels is preferentially reactive to vacuum forces to a much greater extent initially than the second pair of controlled deflection flex panels, it is preferred to not have ribs incorporated within the first pair of panels, in order to allow easier movement of the panels.

The vacuum panels should be selected so that they are highly efficient. See, for example, PCT application NO. PCT/NZ00/00019 (David Melrose) where panels with vacuum panel geometry are shown. 'Prior art' vacuum panels are generally flat or concave. The controlled deflection flex panel of Melrose of PCT/NZ00/00019 and the present invention is outwardly curved and can extract greater amounts of pressure. Each flex panel has at least 2 regions of differing outward curvature. The region that is less outwardly curved, the initiator region, reacts to changing pressure at a lower threshold than the region that is more outwardly curved. By providing an initiator portion, the control portion (the region that is more outwardly curved) reacts to pressure more readily than would normally happen. Vacuum pressure is thus reduced to a greater degree than prior art causing less stress to be applied to the container sidewalls. This increased venting of vacuum pressure allows for many design options: different panel shapes, especially outward curves; lighter weight containers; less failure under load; less panel area needed; different shape container bodies.

The controlled deflection flex panel can be shaped in many different ways and can be used on inventive structures that are not standard and can yield improved structures in a container.

All sidewalls containing the controlled deflection flex panels may have one or more ribs located within them. The ribs can have either an outer or inner edge relative to the inside of the container. These ribs may occur as a series of parallel ribs. These ribs are parallel to each other and the base. The number of ribs within the series can be either an odd or even. The number, size and shape of ribs are symmetric to those in the opposing sidewall. Such symmetry enhances stability of the container.

Preferably, the ribs on the side containing the second pair of controlled deflection panels and having the largest surface area of panel, are substantially identical to each other in size and shape. The individual ribs can extend across the length or width of the container. The actual length, width and depth of the rib may vary depending on container use, plastic material employed and the demands of the manufacturing process. Each rib is spaced apart relative to the others to optimize its and the overall stabilization function as an inward or outward rib. The ribs are parallel to one another and preferably, also to the container base.

The advanced highly efficient design of the controlled deflection panels of the first pair of panels more than compensates for the fact that they offer less surface area than the larger front and back panels. By providing for the first pair of panels to respond to lower thresholds of pressure, these panels may begin the function of vacuum compensation before the second larger panel set, despite being positioned further from the centerline. The second larger panel set may be constructed to move only minimally, and relatively evenly in response to vacuum pressure, as even a small movement of these panels provides adequate vacuum compensation due to the increased surface area. The first set of controlled deflection flex panels may be constructed to invert and provide much of the vacuum compensation required by the package in order to prevent the larger set of panels from entering an inverted position. Employment of a thin walled super light weight preform ensures that a high level of orientation and crystallinity are imparted to the entire package. This increased level of strength together with the rib structure and highly efficient vacuum panels provide the container with the ability to maintain function and shape on cool down, while at the same time utilizing minimum gram weight.

The arrangement of ribs and vacuum panels on adjacent sides within the area defined by upper and lower container bumpers allows the package to be further light weighted without loss of structural strength. The ribs are placed on the larger, non-inverting panels and the smaller inverting panels may be generally free of rib indentations and so are more suitable for embossing or debossing of Brand logos or name. This configuration optimizes geometric orientation of squeeze bottle arrangements, whereby the sides of the container are partially drawn inwardly as the main larger panels contract toward each other. Generally speaking, in prior art as the front and back panels are drawn inwardly under vacuum the sides are forced outwardly. In the present invention the side panels invert toward the centre and maintain this position without being forced outwardly beyond the post structures between the panels. Further, this configuration of ribs and vacuum panel represents a departure from tradition.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DESCRIPTION OF THE DRAWINGS

FIGS. 7 *a-e* show front, side and cross-section views of an alternative embodiment of the container having 2 sets of panels having variable curvatures.

FIGS. 8 *a-e* show front, side and cross-section views of an alternative embodiment of the container having 2 sets of panels having variable projecting curvatures.

FIGS. 10 *a-e* show front, side and cross-section views of an alternative embodiment of the container having 2 sets of panels with one set having an even outward curvature and one set having a variable outward curvature.

FIGS. 13 *a-e* show front, side and cross-section views of an alternative embodiment of the container having 2 sets of panels with one set of panels having variable outward curvatures and one set of panels being substantially concave.

FIGS. 14 *a-e* show front, side and cross-section views of an alternative embodiment of the container having 2 sets of panels with one set of panels having even outward curvatures and one set of panels having variable inward curvatures.

DETAILED DESCRIPTION OF THE INVENTIONS

A thin-walled container in accordance with the present invention is intended to be filled with a liquid at a temperature above room temperature. According to the invention, a container may be formed from a plastic material such as polyethylene terephthalate (PET) or polyester. Preferably, the container is blow molded. The container can be filled by automated, high speed, hot-fill equipment known in the art.

Figure 2:
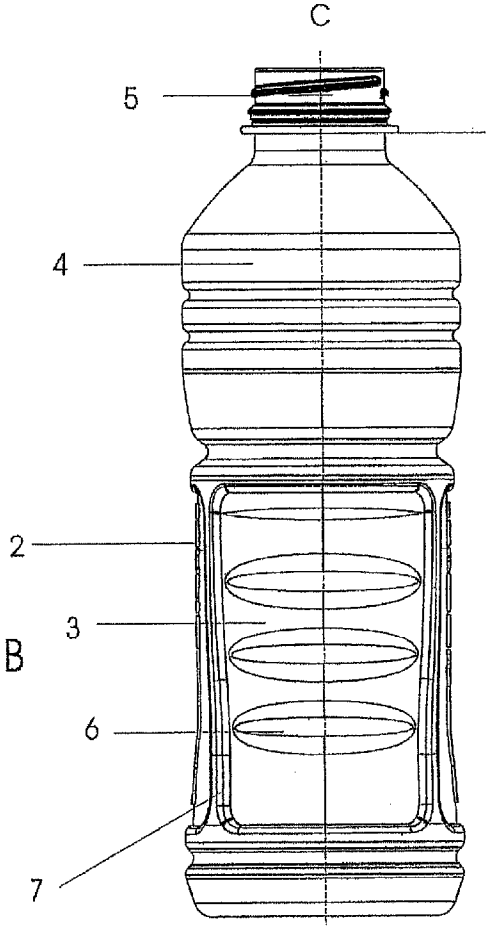
FIG. 2 shows a front view of the container shown in FIG. 1.
Figure 1:
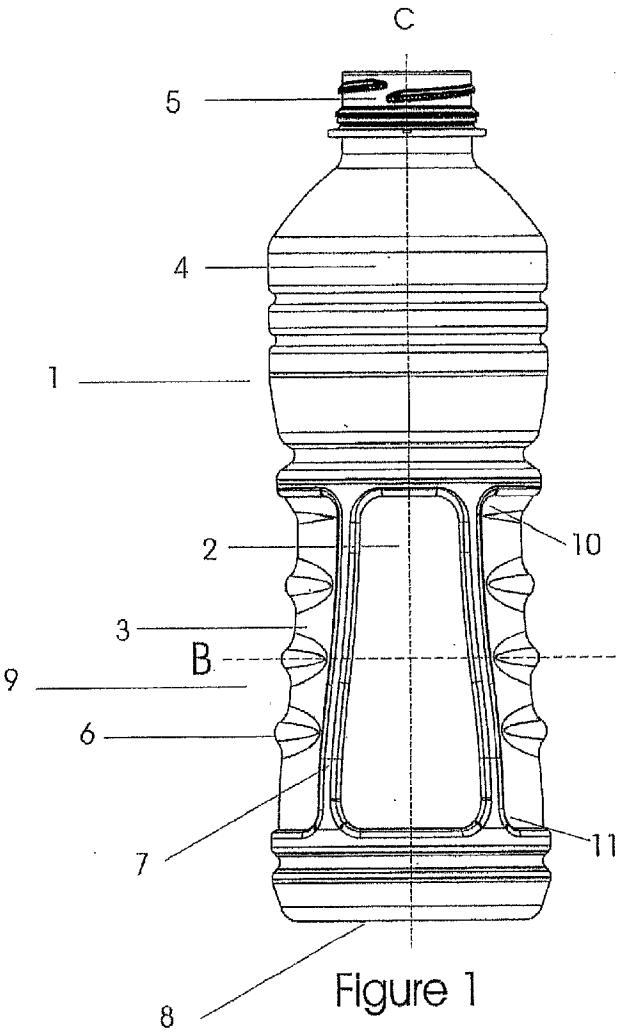
FIG. 1 shows a side view of the container showing the embodiment having a series of symmetrical ribs on the larger controlled deflection flex panels.
Figure 3C:
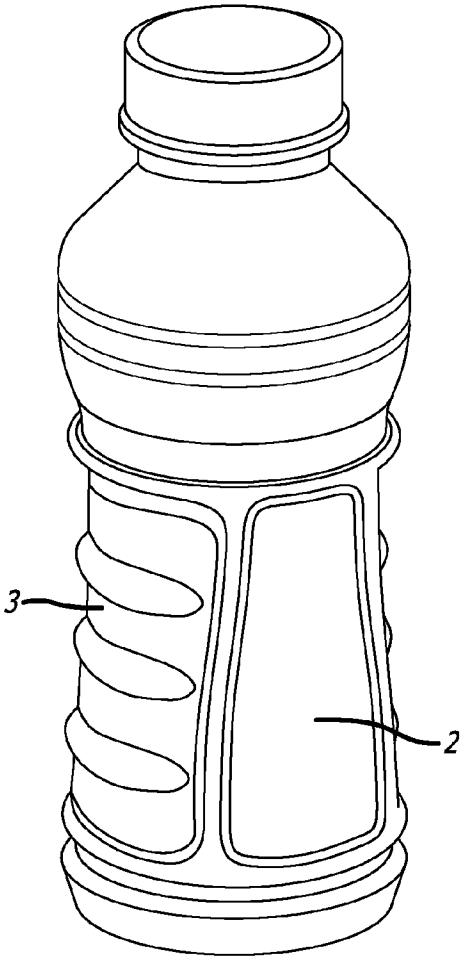
FIGS. 3*a-c* show rendered side, front, and perspective solid views of the container shown in FIGS. 1 and 2.
Figure 3B:
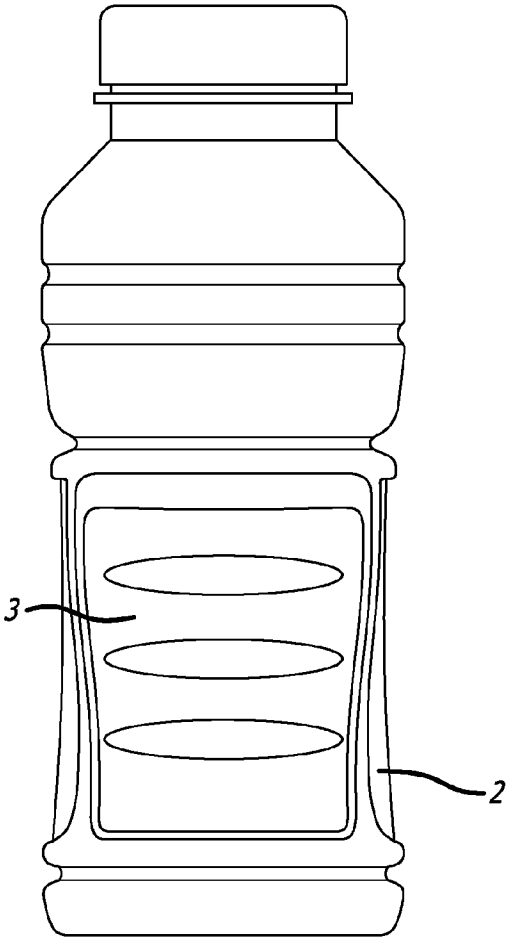
Figure 3A:
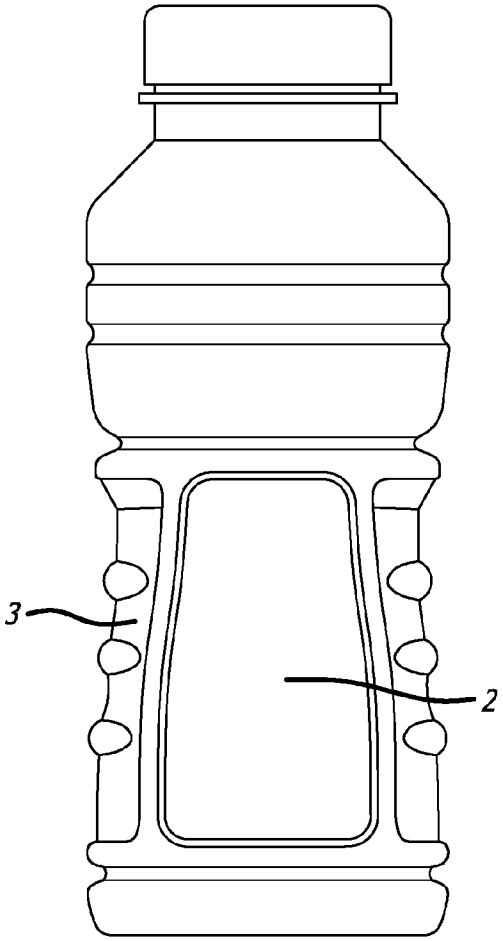
Figure 4A:
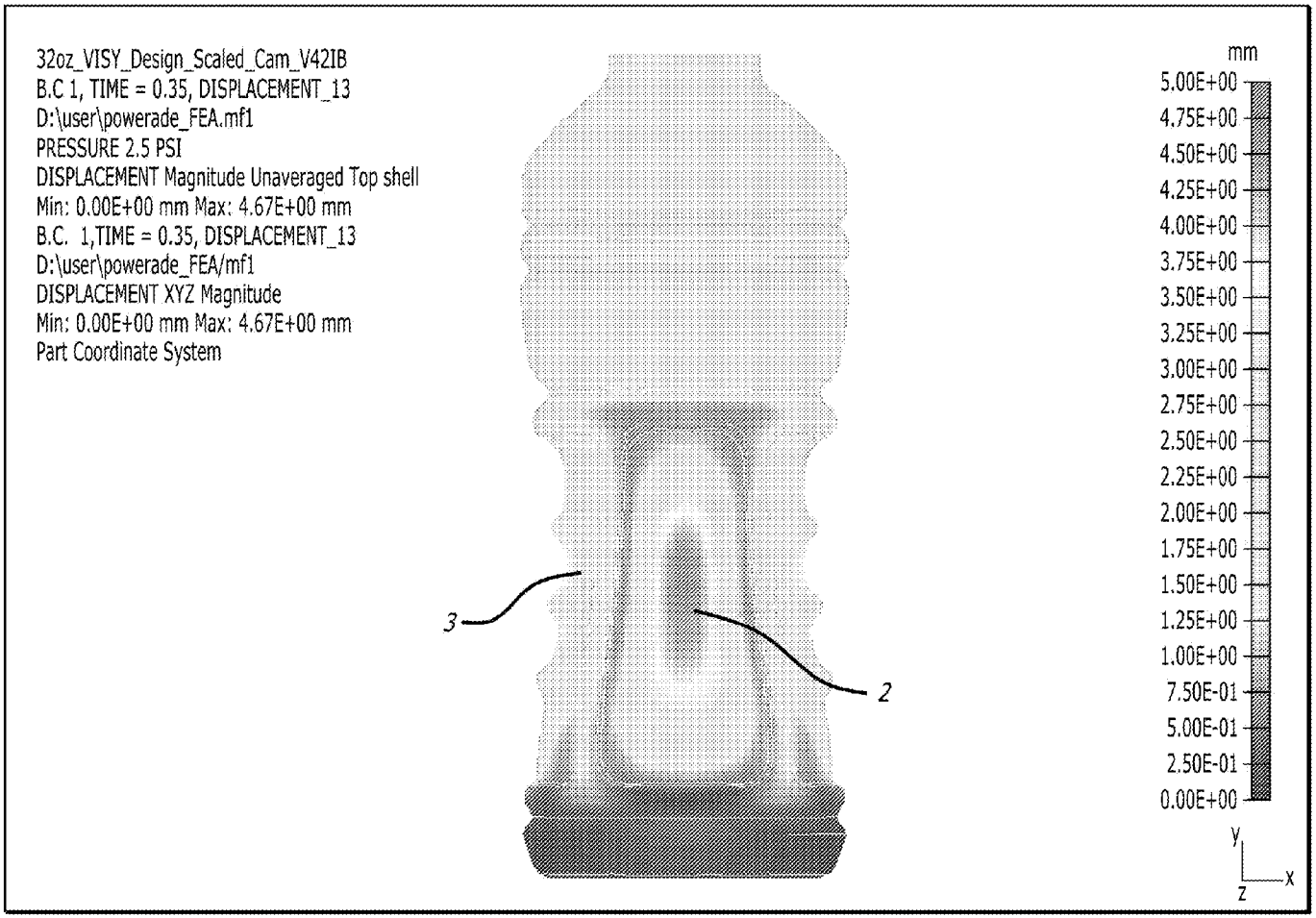
FIG. 4*a* shows a Finite Element Analysis view of the container shown in FIG. 1 under vacuum pressure Step One.
Figure 4B:
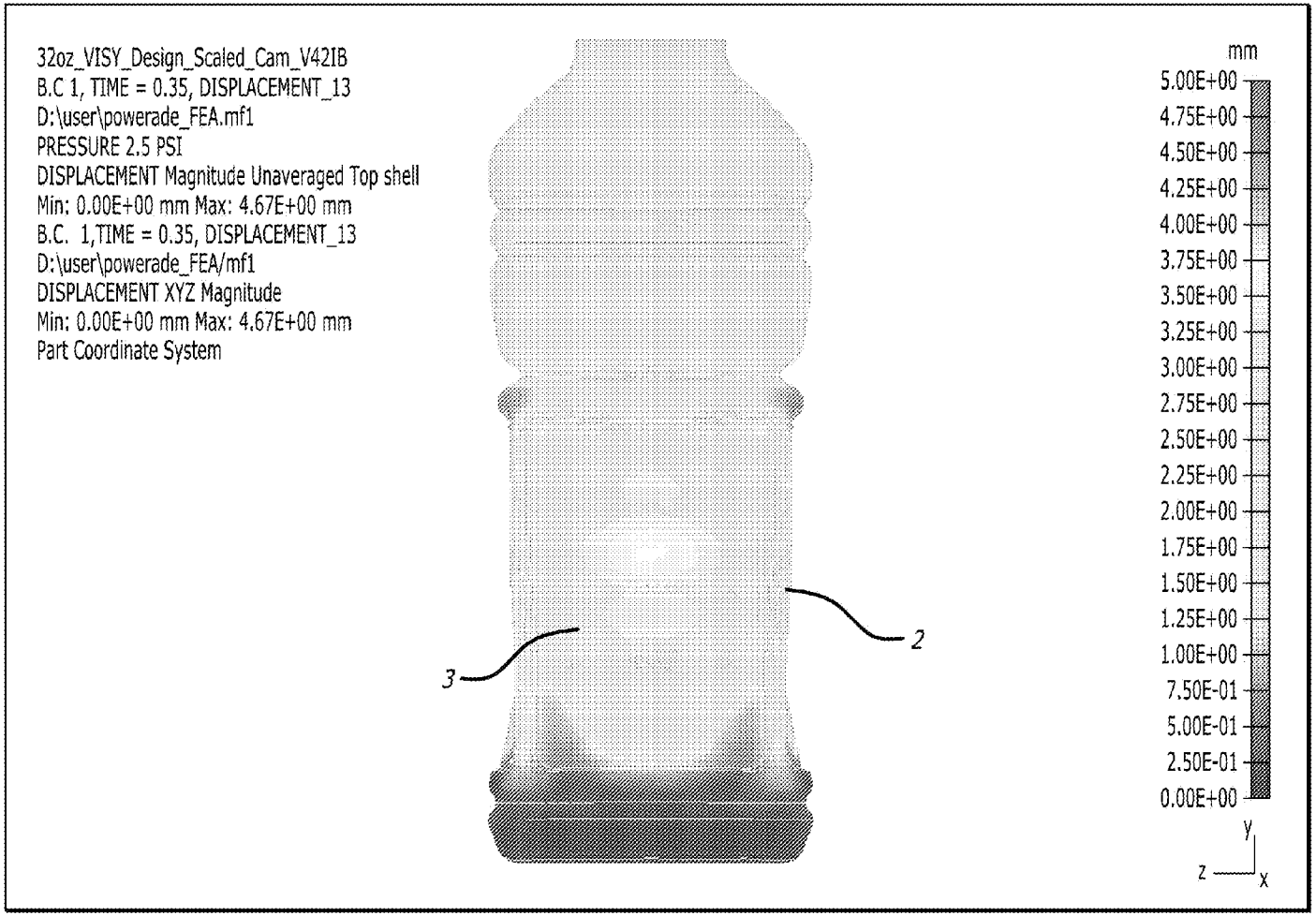
FIG. 4*b* shows a Finite Element Analysis view of the container shown in FIG. 2 under vacuum pressure Step One.
Figure 5A:
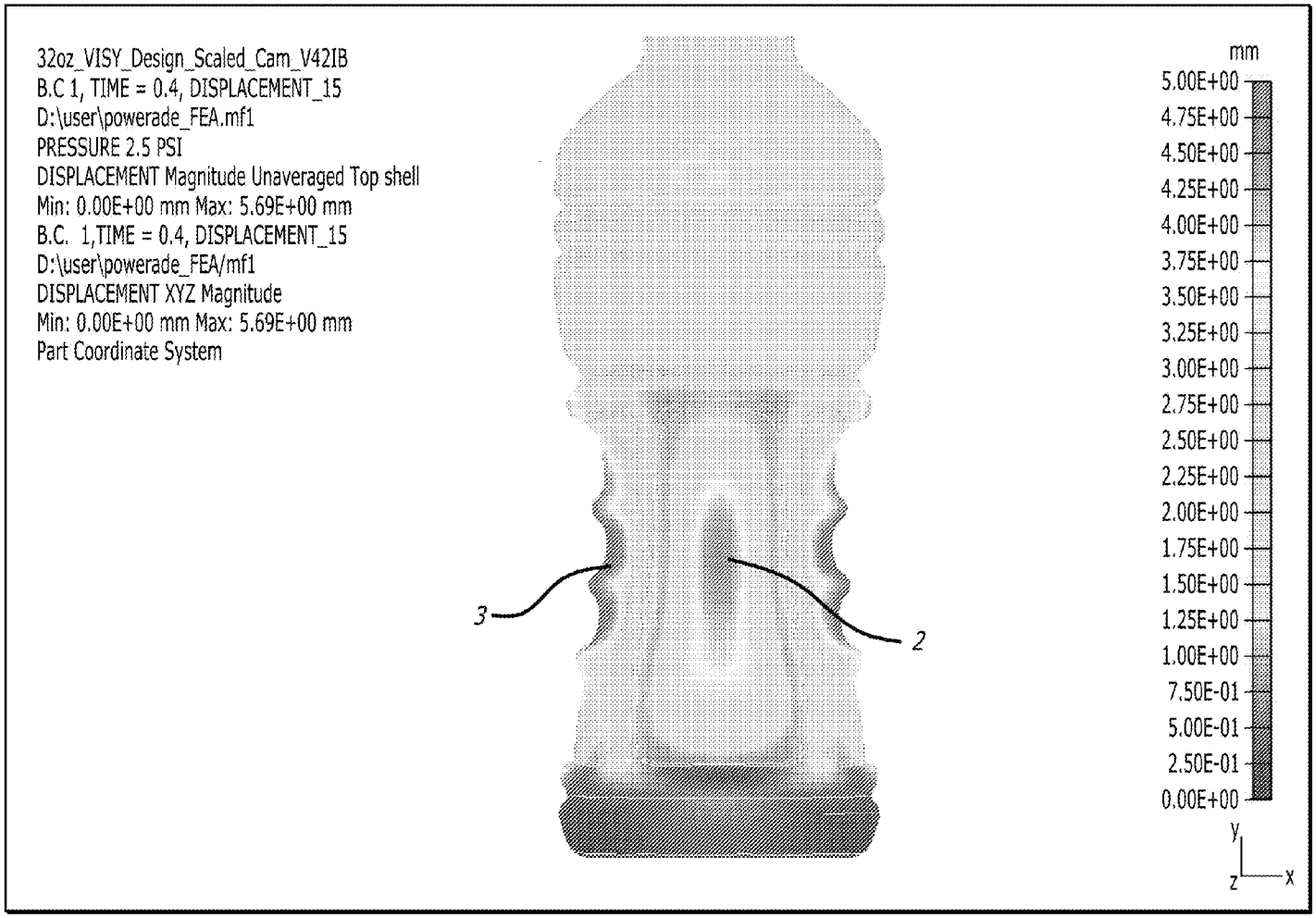
FIG. 5*a* shows a Finite Element Analysis view of the container shown in FIG. 1 under vacuum pressure Step Two.
Figure 5B:
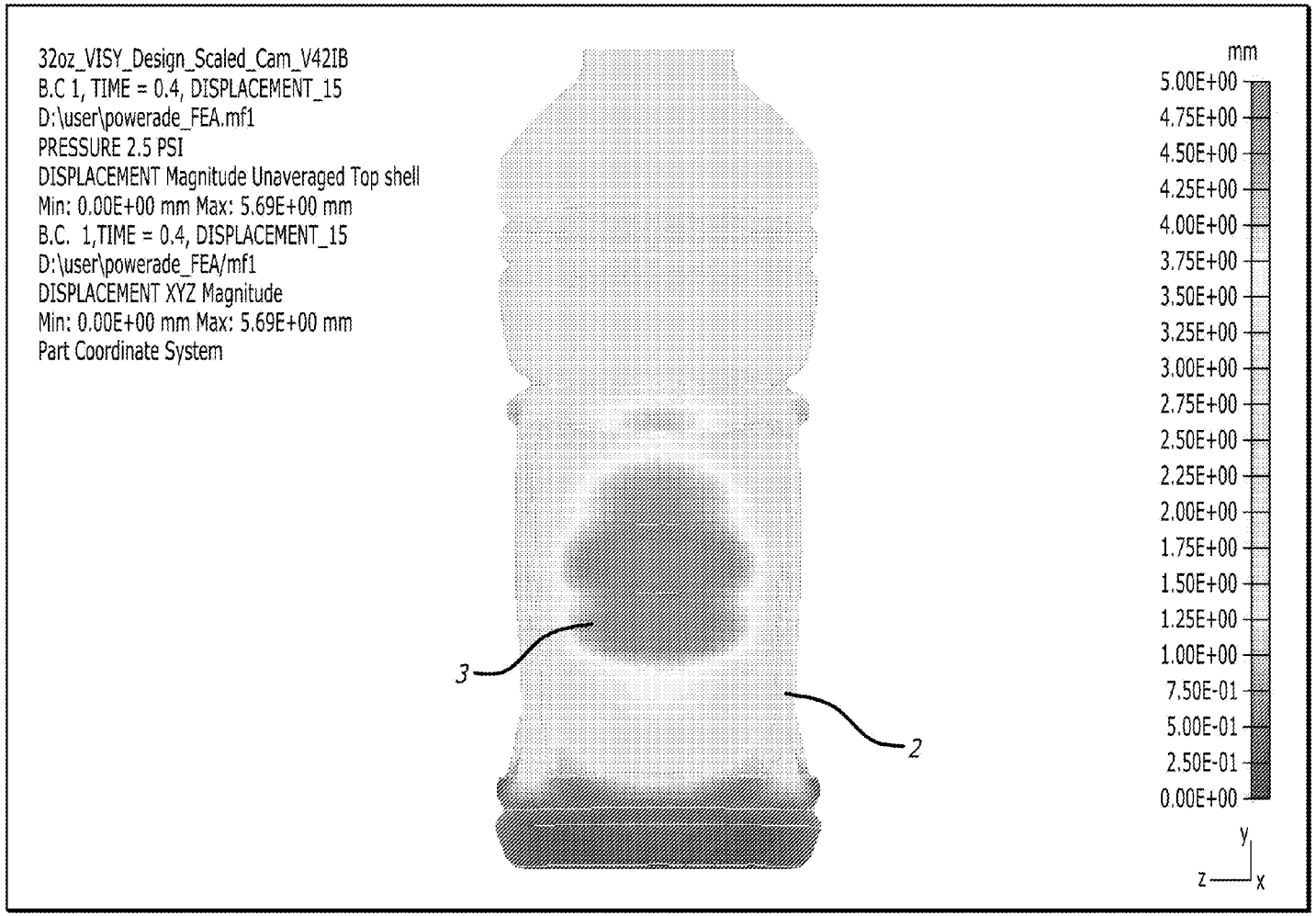
FIG. 5*b* shows a Finite Element Analysis view of the container shown in FIG. 2 under vacuum pressure Step Two.

Referring now to the drawings, a preferred embodiment of the container of this invention is indicated generally in FIG. 1, as generally having many of the well known features of hot-fill bottles. The container (1), which is generally round or oval in shape, has a longitudinal axis (C) when the container is standing upright on its base. The container comprises a threaded neck (5) for filling and dispensing fluid. Neck (5) also is sealable with a cap (not shown). The preferred container further comprises a substantially circular base (8) and a bell (4) located below neck (5) and above base (8). The container of the present invention also has a body (9) defined by substantially round sides containing a pair of narrower controlled deflection flex panels (2) and a pair of wider controlled deflection flex panels (3) that connect bell (4) and base (8). A label or labels can easily be applied to the bell area using methods that are well known to those skilled in the art, including shrink wrap labeling and adhesive methods. As applied, the label extends either around the entire bell of the container or extends over a portion of the label mounting area.

Generally, the substantially rectangular flex panels (3) containing one or more ribs (6) are those with a width greater than the pair of flex panels adjacent (2) in the body area (9). The placement of the controlled deflection flex panel (3) and the ribs (6) are such that the opposing sides are symmetrical. These flex panels (3) have rounded edges. The vacuum panels (3) permit the bottle to flex inwardly upon filling with the hot fluid, sealing, and subsequent cooling. The ribs (6) can have a rounded outer or inner edge, relative to the space defined by the sides of the container. The ribs typically extend most of the width of the side and are parallel with each other and the base. The width of these ribs is selected consistent with achieving the rib function. The number of ribs on either adjacent side can vary depending on container size, rib number, plastic composition, bottle filling conditions and expected contents. The placement of ribs on a side can also vary so long as the desired goal(s) associated with the interfunctioning of the ribbed flex panels and the non-ribbed flex panels is not lost. The ribs are also spaced apart from the upper and lower edges of the vacuum panels, respectively, and are placed to maximize their function. The ribs of each series are noncontinuous, i.e., they do not touch each other. Nor do they touch a panel edge.

The number of vacuum panels is variable. However, two symmetrical panels, each on the opposite sides of the container, are preferred. The controlled deflection flex panel (3) is substantially rectangular in shape and has a rounded upper edge (10) and a rounded lower edge (11).

As shown in FIG. 1, the narrower side contains the controlled deflection flex panel (2) that does not have rib strengthening. Of course, the panel (2) may also incorporate a number of ribs of varying length and configuration. It is also preferred that any ribs positioned on this side correspond in positioning and size to their counterparts on the opposite side of the container.

Figure 6A:
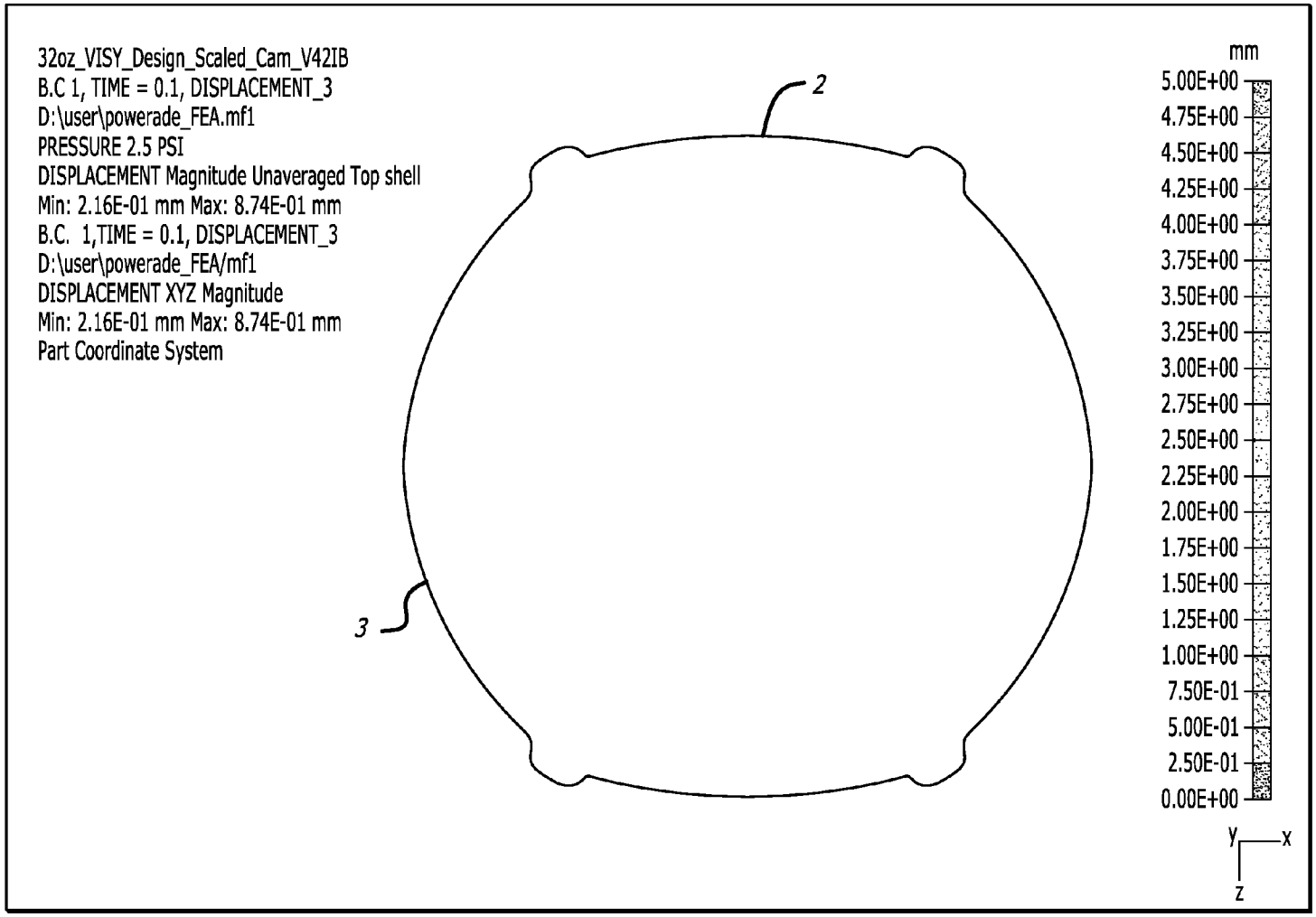
FIGS. 6*a-e* show Finite Element Analysis cross-sectional views through line B-B of the container shown in FIG. 1 under vacuum pressure Step One to Five.
Figure 6B:
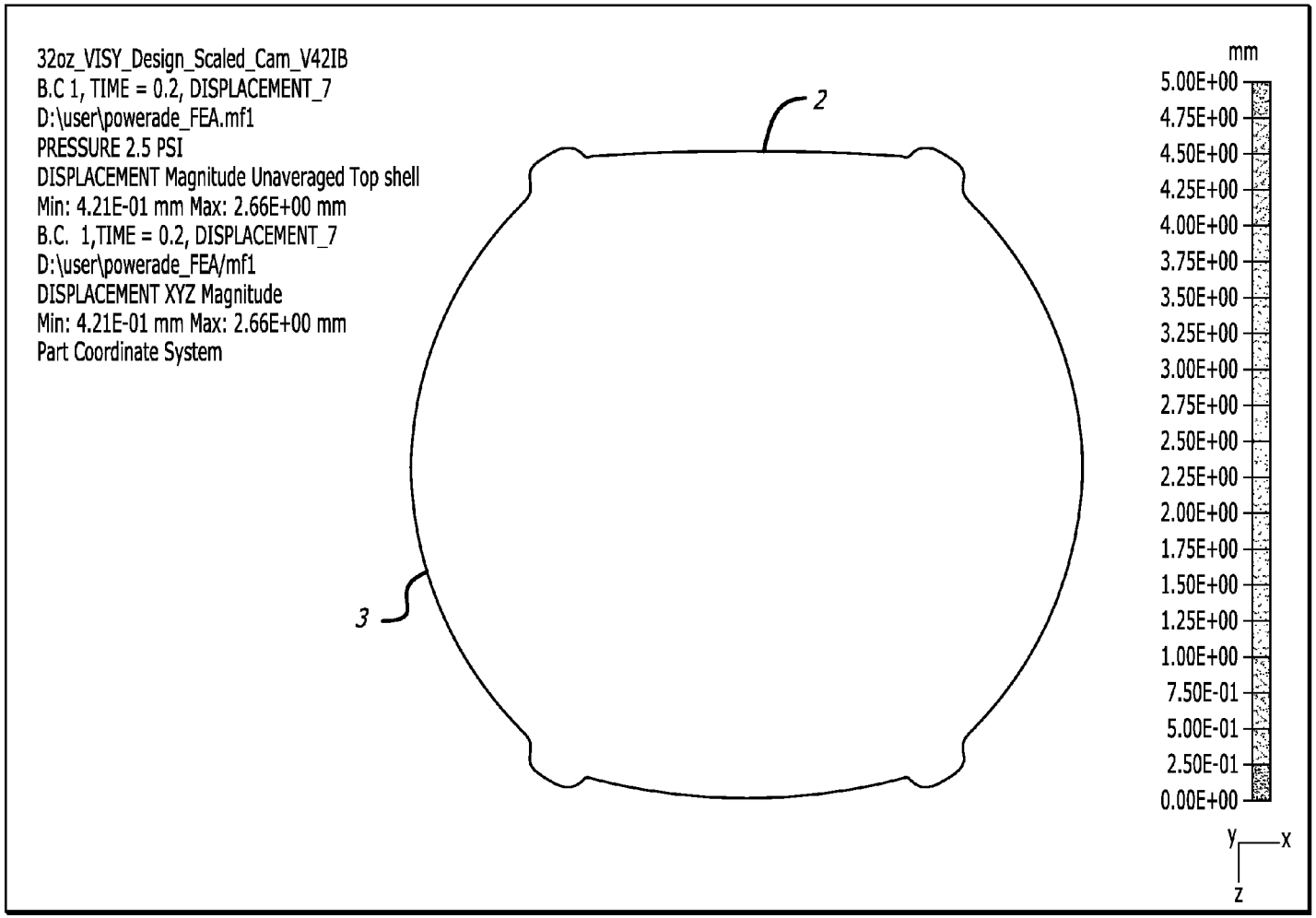
Figure 6C:
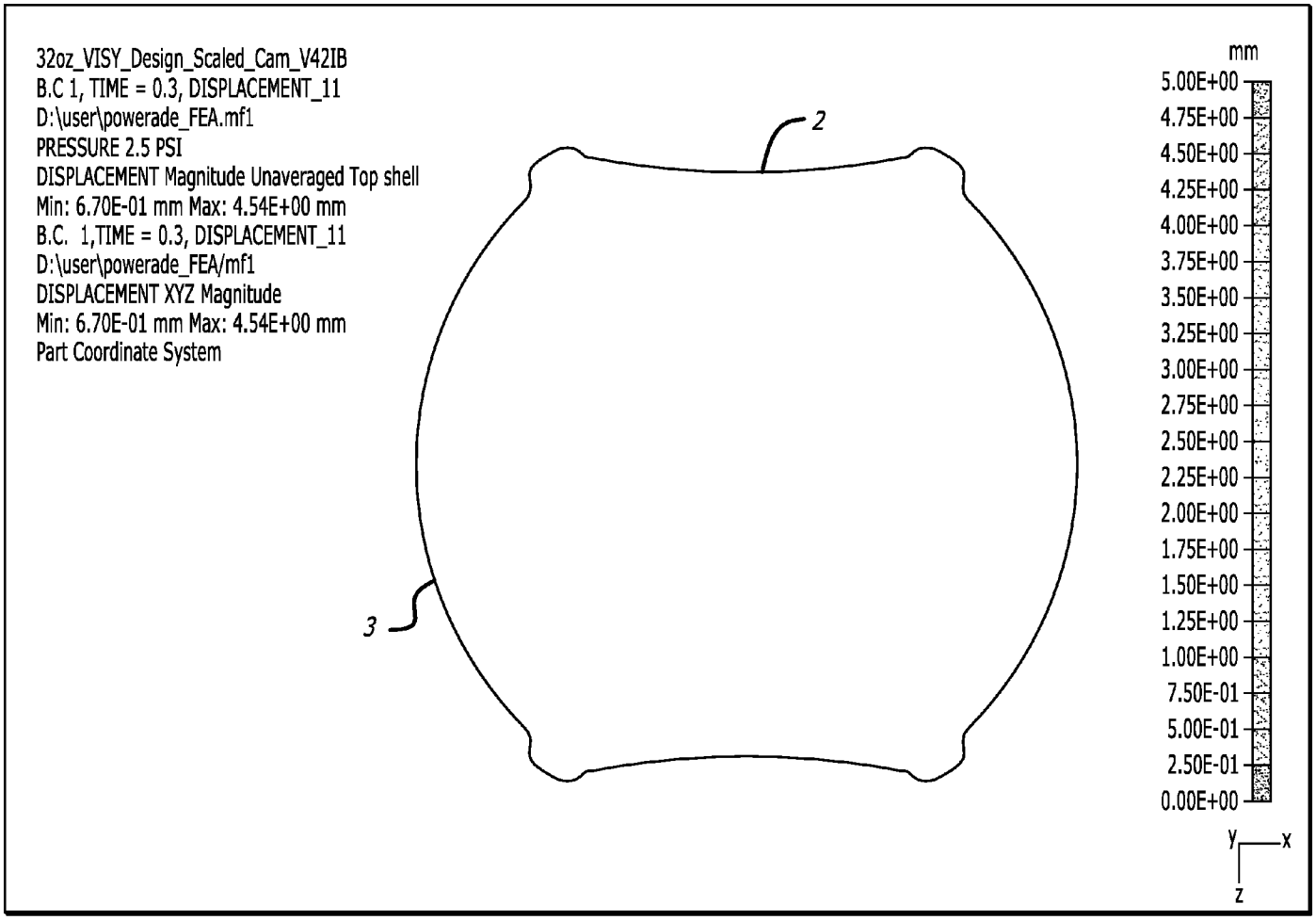
Figure 6D:
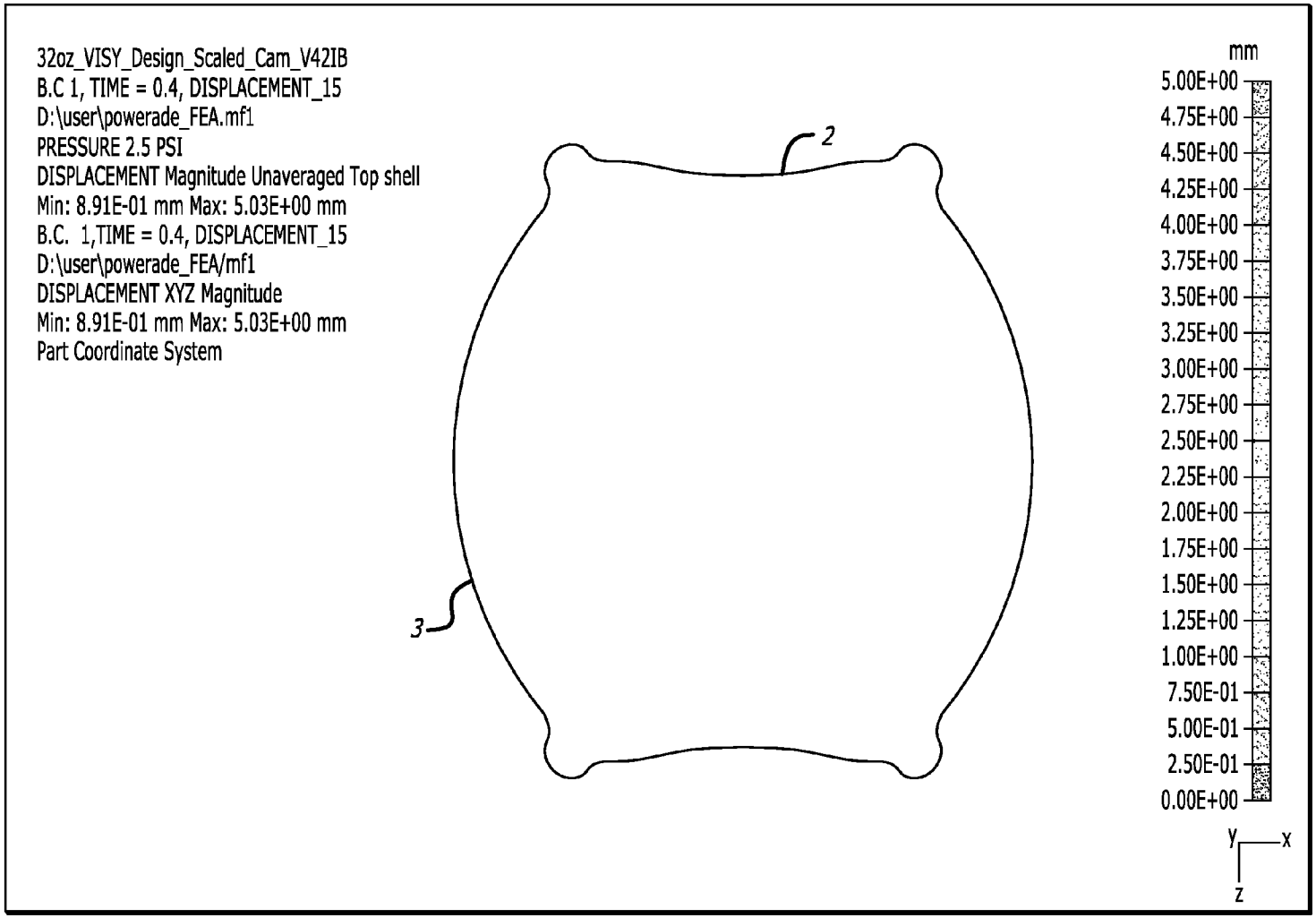
Figure 6E:
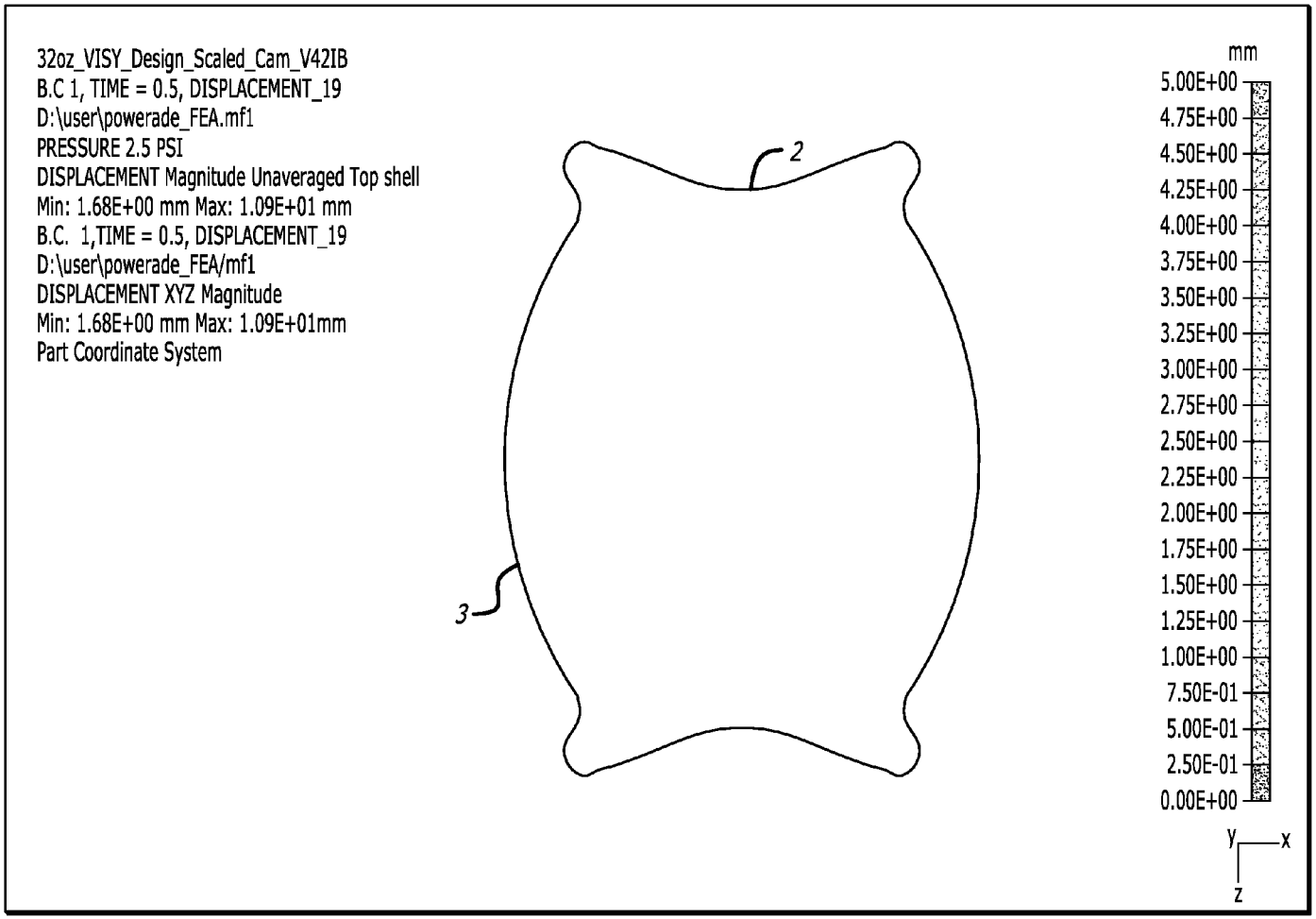

Each controlled deflection flex panel (2) is generally outwardly curved in cross-section. Further, the amount of outward curvature varies along the longitudinal length of the flex panel, such that response to vacuum pressure varies in different regions of the flex panel. FIG. 6*a* shows the outward curvature in cross-section through Line B-B of FIG. 1. A cross-section higher through the flex panel region, i.e. closer to the bell, would reveal the outward curvature to be less than through Line B-B, and a cross-section through the flex panel relatively low on the body and closer to the junction with the base of the container would reveal a greater outward curvature than through Line B-B.

Each controlled deflection flex panel (3) is also generally outwardly curved in cross-section. Similarly, the amount of outward curvature varies along the longitudinal length of the flex panel, such that response to vacuum pressure varies in different regions of the flex panel. FIG. 6*a* shows the outward curvature in cross-section through Line B-B of FIG. 1. A cross-section higher through the flex panel region, i.e. closer to the bell, would reveal the outward curvature to be less than through Line B-B, and a cross-section through the flex panel relatively low on the body and closer to the junction with the base of the container would reveal a greater outward curvature than through Line B-B.

Importantly, the amount of arc curvature contained within controlled deflection flex panel (2) is different to that contained within controlled deflection flex panel (3). This provides greater control over the movement of the larger flex panels (3) than would be the case if the panels (2) were not present or replaced by strengthened regions, or land areas or posts for example. By separating a pair of flex panels (3), which are disposed opposite each other, by a pair of flex panels (2), the amount of vacuum force generated against flex panels (3) during product contraction can be manipulated. In this way undue distortion of the major panels may be avoided.

In this preferred embodiment, the flex panels 2 provide for earlier response to vacuum pressure, thus removing pressure response necessity from flex panels 3. FIGS. 6*a* to 6*e* show gradual increases in vacuum pressure within the container. Flex panels (2) respond earlier and more aggressively than flex panels (3), despite the larger size of flex panels (3) which would normally provide most of the vacuum compensation within the container. Controlled deflection flex panels (2) invert and remain inverted as vacuum pressure increases. This results in full vacuum accommodation being achieved well before full potential is realized from the larger flex panels (3). Controlled deflection flex panels (3) may continue to be drawn inwardly should increased vacuum be experienced under aggressive conditions, such as greatly decreased temperature (deep refrigeration) or if the product is aged leading to increased migration of oxygen and other gases through the plastic sidewalls, also causing increased vacuum force.

The improved arrangement of the present invention provides for a greater potential for response to vacuum pressure than prior art. The container may be squeezed to expel contents as the larger panels (3) are squeezed toward each other, or even if the smaller panels (2) are squeezed toward each other. Release of squeeze pressure results in the container immediately returning to its intended shape rather than remain buckled or distorted. This is a result of having the opposing set of panels having a different response to vacuum pressure levels. In this way, one set of panels will always set the configuration for the container as a whole and not allow any redistribution of panel set that might normally occur otherwise.

Vacuum response is spread circumferentially throughout the container, but allows for efficient contraction of the sidewalls such that each pair of panels may be drawn toward each other without undue force being applied to the posts (7) separating each panel. This overall setup leads to less container distortion at all levels of vacuum pressure than prior art, and less sideways distortion as the larger panels are brought together. Further, a higher level of vacuum compensation is obtained through the employment of smaller vacuum panels set between the larger ones, than would otherwise be obtained by the larger ones alone. Without the smaller panels undue force would be applied to the posts by the contracting larger panels, which would take a less favourable orientation at higher vacuum levels.

The above is offered by way of example only, and the size, shape, and number of the panels (2) and the size, shape, and number of the panels (3), and the size, shape, and number of reinforcement ribs is related to the functional requirements of the size of the container, and could be increased or decreased from the values given.

FIGS. 7 *a-e*, show front, side and cross-section views of an alternative embodiment of the container having 2 sets of panels, the primary panels (2) having variable curvatures whereby their middle portion is relatively flat, or has a lesser amount of curvature than the portions in the upper or lower regions of the panel. The secondary panels (3) also have variable curvatures whereby the middle portion has a greater amount of curvature than the regions above and below. This middle region also projects outwardly to a lesser extent or degree than the region of the panel above or below. By providing a central portion having a greater amount of curvature, or a lesser radius of curvature, the central portion is somewhat strengthened against flexure compared to the regions having lesser amounts of curvature, or a greater radius of curvature.

By providing such variable curvatures within a panel, a great degree of control can be exhibited over the panel and how flexure occurs under vacuum pressure. A certain rate of flexure can be obtained with a high degree of accuracy.

Additionally, by providing for the secondary panel to have a lesser projecting region in the middle portion, the amount of resistance introduced already by the increased amount of curvature can be further modified. The lesser projection causes a degree of lesser resistance to vacuum pressure and ensures the central portion flexes at the correct rate.

The primary panels (2) have a lesser outwardly projecting portion in the centre, and this region also has a lesser amount of curve, or larger radius of curvature than the regions above and below. Therefore, the combined effect is to control the overall flexure of the four panels under vacuum pressure, such that the primary panels flex readily despite having a smaller surface area and being further displaced from the centerline than the secondary panels.

Importantly, the rate of flexure can be controlled between the 2 sets of panels to create a better balance and allowing the container to avoid uncontrolled collapse, and to provide for greater vacuum absorption.

As shown in FIGS. 8 *a-e,* 2 sets of panels having variable projecting curvatures whereby the primary panels (2) have a similar construction to the primary panels in FIGS. 7 *a-e*, but the secondary panels are constructed to respond at a slightly lower vacuum threshold than the secondary panels in FIGS. 7 *a-e*. This is achieved by having the secondary panels in this instance have the same radius of curvature through the middle portion rather than the smaller radius of curvature in FIGS. 7 *a-e.*

Figures 9C, 9D, 9E:
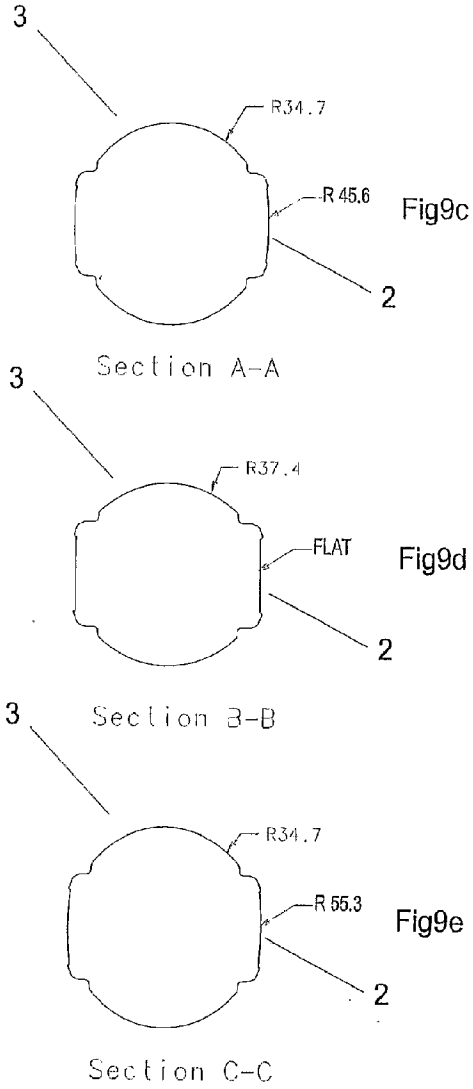
FIGS. 9 *a-e* show front, side and cross-section views of an alternative embodiment of the container having 2 sets of panels having variable curvatures.
Figure 9B:
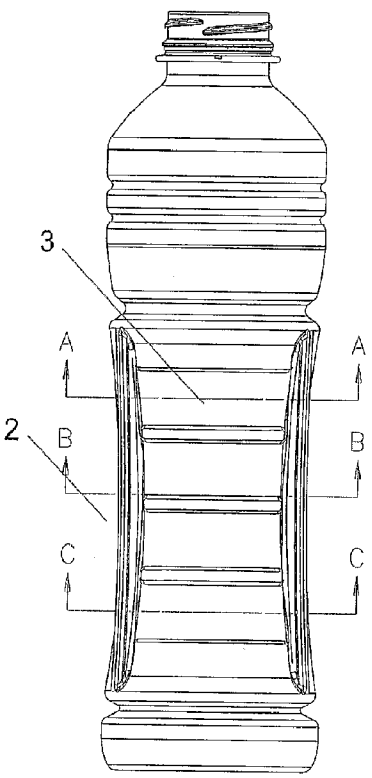
Figure 9A:
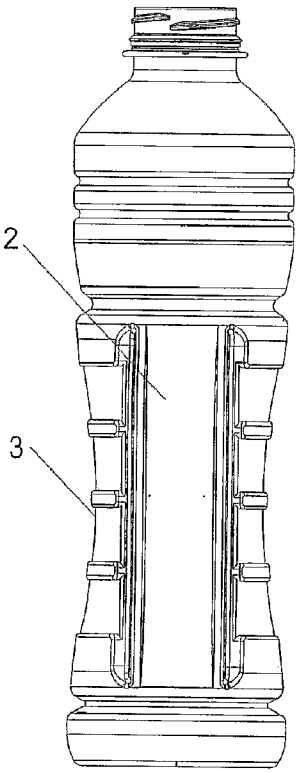

FIGS. 9 *a-e* show an alternative embodiment of the container again, having 2 sets of panels having variable curvatures. In this example the secondary panels (3) have a middle region that is further weakened against vacuum pressure by having a lesser amount of arc, or increased radius of curvature, than the regions above or below. Thus, the four panels are constructed in a similar manner to those in FIGS. 8 *a-e*, but the secondary panels will respond to vacuum pressures earlier by comparison.

FIGS. 10 *a-e* show an alternative embodiment of the container having 2 sets of panels with one set having an even outward curvature and one set having a variable outward curvature. By comparison to the previous example in FIGS. 9 *a-e*, the secondary panels (3) are somewhat more resistant to vacuum pressure as the middle portion shares a common radius of curvature, and a common projection with the regions above and beyond. This creates a panel that is stiffer and slower to respond to vacuum pressure. Subsequently, the primary panels (2) respond significantly faster than the secondary panels, but overall response within the container is different to all the previous examples.

Figures 11C, 11D, 11E:
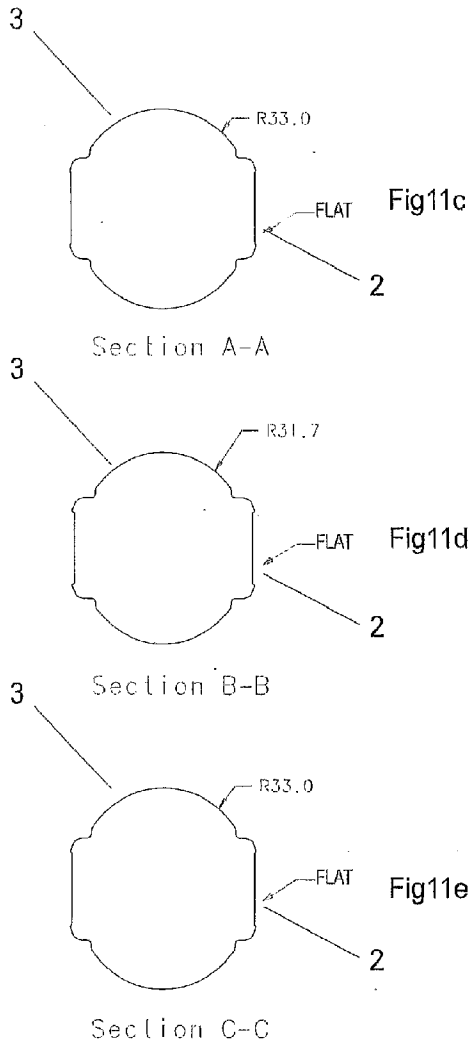
FIGS. 11 *a-e* show front, side and cross-section views of an alternative embodiment of the container having 2 sets of panels with one set of panels having variable outward curvatures and one set being substantially flat.
Figure 11B:
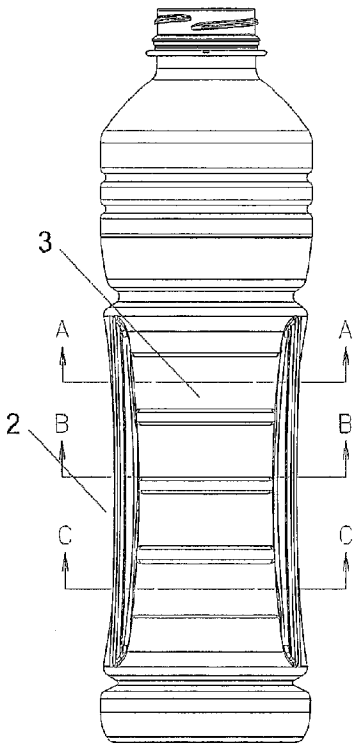
Figure 11A:
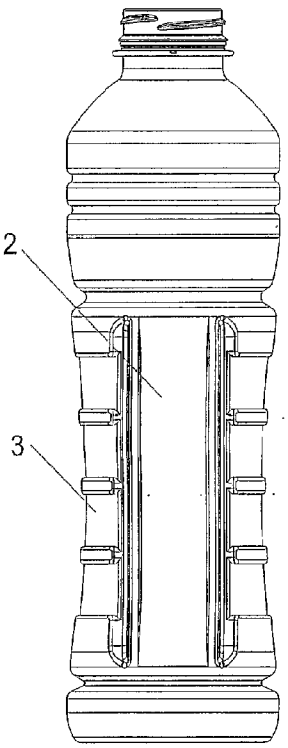

FIGS. 11 *a-e* show a further alternative embodiment of the container having 2 sets of panels with one set of panels (3) having variable outward curvatures and one set of panels (2) being substantially flat. In this example the primary panels (2) will not have the same total volume extraction available as in the previous examples and will respond initially at a similar rate, but then slow in extraction and cause the secondary panels to in fact speed up in response to vacuum after the initial volume compensation is achieved.

Figures 12C, 12D, 12E:
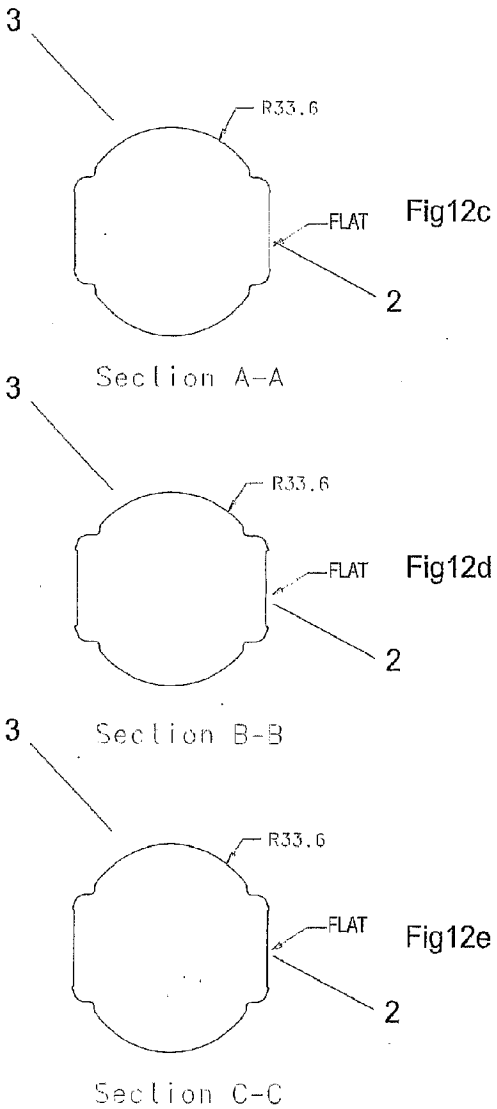
FIGS. 12 *a-e* show front, side and cross-section views of an alternative embodiment of the container having 2 sets of panels with one set of panels having variable projecting curvatures and one set being substantially flat.
Figure 12B:
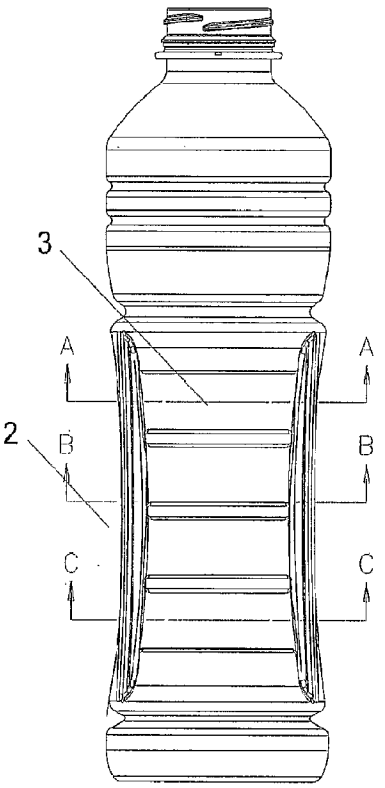
Figure 12A:
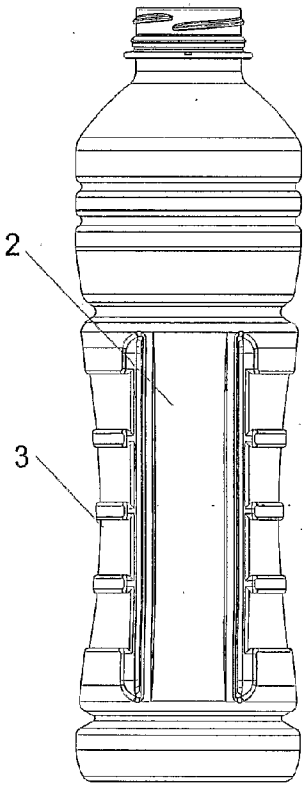

FIGS. 12 *a-e* show another alternative embodiment of the container having 2 sets of panels with one set of panels having variable projecting curvatures and one set being substantially flat. Again, the combination provides for alternative speed responses between the panels.

FIGS. 13 *a-e* show front, side and cross-section views of an alternative embodiment of the container having 2 sets of panels with one set of panels having variable outward curvatures and one set of panels being substantially concave. In this embodiment, the primary panels react earlier to vacuum pressure due to being concave, particularly in the middle regions, but overall extraction from the primary panels is limited due to the lack of any outward curvature. This causes the secondary panels (3) to need to provide for a greater amount of the extraction required, whereby the panels are drawn closer to the centerline and therefore closer together, under vacuum pressure.

FIGS. 14 *a-e* show an alternative embodiment of the container having 2 sets of panels with one set of panels having even outward curvatures and one set of panels having variable inward curvatures. The primary panels (2) are particularly predisposed to reacting in the initial stages in this embodiment. The concavity is more pronounced in the middle portion, wherein the inward radius of curvature is smaller, such that this region reacts more quickly. The secondary panels are further configured to encourage this as they are more stiffly constructed, having a more even outward curvature. Thus, the secondary panels resist the early vacuum pressures at the same time the primary panels more readily respond to vacuum. This creates a greater difference in response at early stages of vacuum pressure between the panels.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

All references cited in this specification are hereby incorporated by reference. The discussion of the references herein is intended merely to summarize the assertions made by their authors and no admission is made that any reference constitutes prior art relevant to patentability and the applicant reserves the right to challenge the accuracy and pertinency of the cited references.

Although this invention has been described by way of example and with reference to possible embodiments thereof, it is to be understood that modifications or improvements may be made thereto without departing from the scope of the invention as defined in the appended claims.

The invention claimed is:

1. A container for accommodating volume contraction within the container after being filled with a heated liquid, having a sidewall portion including four vacuum flex panels spaced apart around the circumference of a body portion, and arranged as a first pair of opposed vacuum flex panels and a second pair of opposed vacuum flex panels, at least one of said vacuum flex panels having at least two different extents of curvature, and a plurality of vertical posts disposed between and joining respective adjacent panels, wherein the panels in at least one pair of the first and second pairs of panels vary in outward curvature along their length and are vertically concave, wherein the vacuum flex panels can deform inwardly to accommodate vacuum pressure caused by volume contraction of the heated liquid and wherein the vacuum flex panels are formed so the first pair of vacuum flex panels deforms inwardly at a different rate than the second pair of vacuum flex panels, wherein the second pair of panels are vertically concave and disposed between the first pair of panels by the posts or by land areas or by vertical transition transitional walls.

2. The container of claim 1 wherein one said pair of panels has a different amount of outward curvature to the other said pair of panels.

3. The container of claim 1 wherein one said pair of panels is substantially flat in the at least one region.

4. The container of claim 1 wherein one said pair of panels has a variable outward curvature.

5. The container of claim 1 wherein one said pair of panels has a generally even outward radius of curvature, excluding any ribs or grip features on said panels.

6. The container of claim 5 wherein one said pair of panels has a variable outward projection.

7. The container of claim 6 wherein a substantially central section of said panels projects outward to a lesser extent.

8. The plastic container of claim 1, said sidewall portion having a maximum outer diameter, and wherein said sidewall portion further comprises: at least one panel of said at least one pair of vacuum panels having a first substantially constant radius of curvature as measured in a horizontal plane, said first substantially constant radius of curvature being substantially constant from an upper end of each of said respective vacuum panels to a lower end, and wherein said first substantially constant radius of curvature is less than said maximum outer diameter; and, at least one of said pair of vacuum panels including gripping structure.

9. The plastic container of claim 1, said sidewall portion having a maximum outer diameter, and wherein said sidewall portion further includes at least one pair of said first and second pairs of vacuum panels each having a first substantially constant radius of curvature as measured in a horizontal plane, said first substantially constant radius of curvature being substantially constant from an upper end portion of each of said respective vacuum panels to a lower end portion, and wherein said first substantially constant radius of curvature is less than said maximum outer diameter; and, at least one of said pair of vacuum panels including gripping structure.

10. A plastic container according to claim 9, wherein said gripping structure comprises at least one protruding rib defined in at least one of said second vacuum panels.

11. The plastic container of claim 1, wherein said sidewall portion further includes one pair of the first and second pairs of opposing vacuum panels having a different radius of curvature to the other pair, at least one panel of said second pair of vacuum panels including gripping structure and being shaped so as to be symmetric about a plane through the at least one of said second vacuum panels when viewed in side elevation.

12. A plastic container according to claim 11, wherein said at least one of said second vacuum panels is further shaped so as to have a width as viewed in side elevation at a first end that is the same as that at a second end.

13. A plastic container according to claim 11, wherein said gripping structure comprises at least one protruding rib defined in at least one of said second vacuum panels.

14. A plastic container according to claim 13, wherein said gripping structure comprises a plurality of said protruding ribs, and wherein said protruding ribs are oriented substantially horizontally as viewed in side elevation.

15. A plastic container according to claim 14, wherein said protruding ribs are not all of equal width.

16. The plastic container of claim 1, said sidewall portion having a maximum outer diameter, and wherein said sidewall portion further comprises:

said first pair of opposing vacuum panels each having a first substantially constant radius of curvature as measured in a horizontal plane; said first substantially constant radius of curvature being substantially constant from an upper end of each of said respective vacuum panels to a lower end, and wherein said first substantially constant radius of curvature is less than said maximum outer diameter; and at least one of said second pair of vacuum panels having gripping structure and having a different radius of curvature as measured in the horizontal plane to the radius of curvature of the other pair of vacuum panels.

17. A plastic container according to claim 16, wherein said second radius of curvature is substantially constant, excluding any gripping structure, from an upper end of each of said respective second vacuum panels to a lower end.

18. A plastic container according to claim 16, wherein said gripping structure comprises at least one protruding rib defined in at least one of said second vacuum panels.

19. A plastic container according to claim 17, wherein said second different radius of curvature is less than said maximum outer diameter.

20. A plastic container having a central longitudinal axis and a body portion including a sidewall wherein said body portion includes:

a first pair of controlled deflection flex panels on opposed sidewall portions, and a second pair of controlled deflection flex panels on second opposed sidewall portions, at least one of said controlled deflection flex panels having at least two different extents of outward curvature, and a plurality of vertical posts disposed between and joining respective adjacent panels, wherein the panels in at least one pair of the first and second pairs of panels vary in outward curvature along their length and are vertically concave, said first pair of controlled deflection flex panels being adapted to react to internal pressure changes and move inwardly within the container, said second pair of controlled deflection flex panels being adapted to react to internal pressure changes and move inwardly within the container, wherein the first pair of controlled deflection flex panels react to a different degree to the second pair of controlled deflection flex panels, wherein the second pair of panels are vertically concave and disposed between the first pair of panels by the posts or by land areas or by vertical transition transitional walls.

21. The plastic container of claim 20 wherein each of the controlled deflection flex panel of the first pair has a width which is less than the width of the controlled deflection flex panels of the second pair.

22. The plastic container of claim 20 wherein each of the controlled deflection flex panels of the second pair has one or a plurality of ribs incorporated within.

23. The plastic container of claim 22 wherein at least one, of said sidewall portions is symmetrical to an opposing side wall portion relative to rib and flex panel placement, size and number.

24. The plastic container of claim 23 wherein a cage structure of ribs and flex panels cooperate to maintain container shape upon filling and cooling of the container.

25. The plastic container of claim 20 wherein the controlled deflection flex panels of the first and second flex panel pairs are adapted to react to pressure changes to a different degree by being of a different size and/or different distance from the central longitudinal axis of the container and/or having a different curvature.

26. The plastic container of claim 20 wherein the container is hot-fillable.

27. The plastic container of claim 20 including a base which is rounded.

28. The plastic container of claims 20 or 21, wherein the opposite controlled deflection flex panels of the first pair each comprise the at least two different extents of outward curvature and the adjacent pair of opposite controlled deflection flex panels of the second pair also each comprise at least two different extents of outward curvature.

29. The plastic container of claim 20 wherein at least one controlled deflection flex panel pair has one or a plurality of ribs incorporated within.

30. The plastic container of claim 22 or 29 wherein the said ribs include either an outward or inwardly facing rounded edge, relative to the interior of the container.

31. The plastic container of claim 30 wherein said ribs are parallel to each other.

32. The plastic container of claim 20 wherein the controlled deflection flex panel having the at least two different extents of outward curvature has a region of generally outward transverse curvature that projects away from the longitudinal axis of the container to a lesser extent than an upper or lower region of the panel.

33. The plastic container of claim 32 wherein the region of generally outward transverse curvature that is less outwardly projecting and acts as an initiating region reacts to changing pressure within the container at a lower threshold than a second region which is more outwardly projecting curved.

34. The plastic container of claim 20 wherein the controlled deflection flex panel having the at least two different extents of outward curvature has a region that inverts under vacuum pressure.

35. The container of either of claim 20 or claim 1 wherein said at least two different extents of curvature comprise varying amounts of projection from a plane defined by a longitudinal axis of said at least one panel.

36. The container of claim 35 wherein a substantially constant arc of curvature is provided along said longitudinal axis of said at least one panel.

37. The container of claim 35 wherein a variable arc of curvature is provided along said longitudinal axis of said at least one panel.

38. A container for accommodating volume contraction within the container after being filled with a heated liquid, having a sidewall portion including four vacuum flex panels spaced apart around the circumference of a body portion, and arranged as a first pair of opposed vacuum flex panels and a second pair of opposed vacuum flex panels, at least one of said vacuum flex panels having at least two different extents of curvature, and a plurality of vertical posts disposed between and joining respective adjacent panels, wherein the panels in at least one pair of the first and second pairs of panels vary in outward curvature along their length and are vertically concave, wherein the vacuum flex panels can deform inwardly to accommodate vacuum pressure caused by volume contraction of the heated liquid and wherein the vacuum flex panels are formed so the first pair of vacuum flex panels deforms inwardly at a different rate than the second pair of vacuum flex panels, the container further comprising upper and lower container bumpers, wherein the second pair of panels are recessed with respect to the upper and lower container bumpers; and wherein said second pair of panels include horizontal ribs.

39. A plastic container having a central longitudinal axis and a body portion including a sidewall wherein said body portion includes:

a first pair of controlled deflection flex panels on opposed sidewall portions, and a second pair of controlled deflection flex panels on second opposed sidewall portions, at least one of said controlled deflection flex panels having at least two different extents of outward curvature, and a plurality of vertical posts disposed between and joining respective adjacent panels, wherein the panels in at least one pair of the first and second pairs of panels vary in outward curvature along their length and are vertically concave, said first pair of controlled deflection flex panels being adapted to react to internal pressure changes and move inwardly within the container, said second pair of controlled deflection flex panels being adapted to react to internal pressure changes and move inwardly within the container, wherein the first pair of controlled deflection flex panels react to a different degree to the second pair of controlled deflection flex panels, the container further comprising upper and lower container bumpers, wherein the second pair of panels are recessed with respect to the upper and lower container bumpers; and wherein said second pair of panels include horizontal ribs.

40. A container as claimed in either of claim 39 or 38, wherein the second pair of panels are vertically concave and disposed between the first pair of panels by the posts or by land areas or by vertical transition transitional walls.

* * * * *